US009346635B2

(12) United States Patent
Hirata et al.

(10) Patent No.: US 9,346,635 B2
(45) Date of Patent: May 24, 2016

(54) SHEET CONTAINER AND IMAGE FORMING APPARATUS INCORPORATING SAME

(71) Applicants: Munekazu Hirata, Osaka (JP); Mitsutaka Nakamura, Hyogo (JP); Takashi Fujimoto, Hyogo (JP); Kozo Yamazaki, Hyogo (JP); Toshio Yamaki, Osaka (JP)

(72) Inventors: Munekazu Hirata, Osaka (JP); Mitsutaka Nakamura, Hyogo (JP); Takashi Fujimoto, Hyogo (JP); Kozo Yamazaki, Hyogo (JP); Toshio Yamaki, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/514,544

(22) Filed: Oct. 15, 2014

(65) Prior Publication Data

US 2015/0102550 A1 Apr. 16, 2015

(30) Foreign Application Priority Data

Oct. 16, 2013 (JP) ..... 2013-215416

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2402/343* (2013.01); *B65H 2402/46* (2013.01); *B65H 2511/10* (2013.01); *B65H 2511/20* (2013.01); *B65H 2551/29* (2013.01)

(58) Field of Classification Search
CPC ..... B65H 1/266; B65H 2511/10; B65H 2511/512; B65H 2405/1122; B65H 2405/1116; B65H 2405/1144; B65H 2405/11164; B65H 2601/422; B65H 2551/29; B65H 2701/1211
USPC ..... 271/171
See application file for complete search history.

(56) References Cited

U.S. PATENT DOCUMENTS

| | | | | |
|---|---|---|---|---|
| 5,172,903 | A * | 12/1992 | Haneda et al. | 271/171 |
| 7,364,153 | B2 * | 4/2008 | Takahashi et al. | 271/127 |
| 7,464,927 | B2 * | 12/2008 | Ito et al. | 271/171 |
| 7,668,502 | B2 * | 2/2010 | Park | 399/393 |
| 7,758,040 | B2 * | 7/2010 | Hashimoto et al. | 271/145 |
| 7,878,501 | B2 * | 2/2011 | Chino | 271/171 |

(Continued)

FOREIGN PATENT DOCUMENTS

| | | |
|---|---|---|
| JP | 8-319029 | 12/1996 |
| JP | 2004-315230 | 11/2004 |

(Continued)

OTHER PUBLICATIONS

U.S. Appl. No. 14/320,720, filed Jul. 1, 2014.

*Primary Examiner* — Patrick Cicchino
(74) *Attorney, Agent, or Firm* — Harness, Dickey & Pierce, P.L.C.

(57) ABSTRACT

A sheet container, which is incorporated in an image forming apparatus, includes a container body having a loading face to load a sheet thereon, an extension unit disposed extendable in a sheet feeding direction with respect to the container body to extend the loading face, a length regulator disposed movable in the sheet feeding direction with respect to the extension unit to regulate a sheet trailing end position in the sheet feeding direction, and a sheet size indicator having a strip-shape provided on the container body along with a moving direction of the extension unit as a reference of a position of the length regulator, having at least one sheet size mark to indicate a size of the sheet, and being variable in length in a longitudinal direction with respect to the container body along with movement of the extension unit.

20 Claims, 20 Drawing Sheets

(56) References Cited

U.S. PATENT DOCUMENTS

| | | | | |
|---|---|---|---|---|
| 7,922,171 | B2 * | 4/2011 | Kawamura et al. | 271/171 |
| 8,136,809 | B2 * | 3/2012 | Furusawa | 271/171 |
| 8,246,045 | B2 * | 8/2012 | Kubo | 271/171 |
| 8,517,376 | B2 * | 8/2013 | Walsh | 271/171 |
| 9,033,336 | B2 * | 5/2015 | Washino | 271/162 |
| 9,073,712 | B2 * | 7/2015 | Kotaka | 271/3.14 |
| 2004/0247349 | A1 | 12/2004 | Takahashi et al. | |
| 2006/0232000 | A1 | 10/2006 | Takahashi et al. | |
| 2008/0084021 | A1 | 4/2008 | Nakamura | |
| 2008/0179818 | A1 | 7/2008 | Hashimoto et al. | |
| 2009/0045566 | A1 | 2/2009 | Nakamura | |
| 2010/0225053 | A1 | 9/2010 | Nakamura et al. | |
| 2010/0270735 | A1 * | 10/2010 | Allwright et al. | 271/171 |
| 2013/0106050 | A1 | 5/2013 | Nishii et al. | |
| 2014/0091518 | A1 | 4/2014 | Nishii et al. | |
| 2014/0239578 | A1 | 8/2014 | Honda et al. | |

FOREIGN PATENT DOCUMENTS

| | | |
|---|---|---|
| JP | 2008-162721 | 7/2008 |
| JP | 2008-207946 | 9/2008 |
| JP | 2009-286573 | 12/2009 |

* cited by examiner

SHEET CONTAINER AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application No. 2013-215416, filed on Oct. 16, 2013 in the Japan Patent Office, the entire disclosure of which is hereby incorporated by reference herein.

BACKGROUND

1. Technical Field

This disclosure relates to a sheet container and an electrophotographic image forming apparatus incorporating the sheet container.

2. Related Art

Known electrophotographic image forming apparatuses such as printers, facsimile machines, and copiers, typically include a sheet container that contains sheets of paper to be fed therefrom to an image forming part for image forming. The sheet container is detachably attached to an apparatus body of an image forming apparatus so that a sheet of paper is fed by a feed roller disposed on the side of the apparatus body to the image forming part.

In order to accommodate various types of sheets with different sizes, the sheet container includes a sheet trailing end regulator and a sheet width direction regulator. The sheet trailing end is movably disposed to regulate the trailing end of the sheet. The sheet width direction regulator is movably disposed to regulate a widthwise direction of the sheet. By moving the sheet trailing end regulator in a forward/backward direction (i.e., in a direction of extension and retraction thereof) in accordance with the size (the length) of the sheet, the leading end of the sheet is set at a given position so that the sheet is fed regardless of the size (the length). By so doing, when the sheet container is attached to the apparatus body of the image forming apparatus, the sheet can be fed with a constant stability regardless of the size of the sheet.

SUMMARY

At least one aspect of this disclosure provides a sheet container including a container body having a loading face to load a sheet thereon, an extension unit disposed extendable in a sheet feeding direction with respect to the container body to extend the loading face, a length regulator disposed movable in the sheet feeding direction with respect to the extension unit to regulate a sheet trailing end position in the sheet feeding direction, and a sheet size indicator having a strip-shape provided on the container body along with a moving direction of the extension unit as a reference of a position of the length regulator, having at least one sheet size mark to indicate a size of the sheet, and being variable in length in a longitudinal direction with respect to the container body along with movement of the extension unit.

Further, at least one aspect of this disclosure provides an image forming apparatus including the above-described sheet container, a sheet conveying device to convey the sheet fed from the sheet container, an image forming device to form an image on the sheet conveyed by the sheet conveying device, and a sheet discharging device to discharge the sheet having the image formed by the image forming device.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
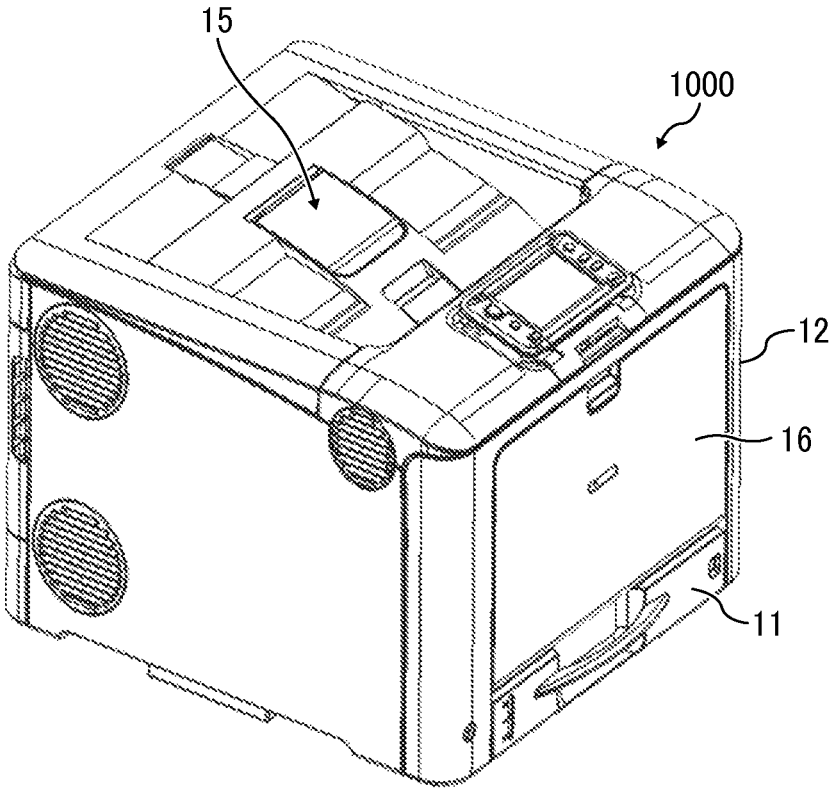
FIG. 1 is a perspective external view illustrating an image forming apparatus incorporating a sheet container according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative teams are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of a sheet conveyor 1100 according to an embodiment of the present invention and an image forming apparatus 1000 incorporating the sheet conveyor 1100.

The image forming apparatus 1000 may be a copier, a facsimile machine, a printer, a plotter, a multifunction peripheral or a multifunction printer (MFP) having at least one of copying, printing, scanning, facsimile, and plotter functions, or the like. According to the present example, the image forming apparatus 1000 is an electrophotographic printer that forms color and monochrome toner images on a sheet or sheets by electrophotography.

More specifically, the image forming apparatus 1000 functions as a printer. However, the image forming apparatus 1000 can expand its function as a copier by adding a scanner as an option disposed on top of an apparatus body of the image forming apparatus 1000. The image forming apparatus 1000 can further obtain functions as a facsimile machine by adding an optional facsimile substrate in the apparatus body of the image forming apparatus 1000.

Further, it is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

A description is given of an external view of the image forming apparatus 1000 that includes the sheet container 11 with reference to FIG. 1.

As illustrated in FIG. 1, the image forming apparatus 1000 is a box-shaped laser printer and includes an apparatus body 12 and the sheet container 11 that can be pulled out from and inserted into a lower part of a front face of the image forming apparatus 1000. A front cover 16 for inspection is provided on a side wall above the sheet container 11. A sheet discharging tray 15 is provided on a top face of the image forming apparatus 1000.

Figure 2:
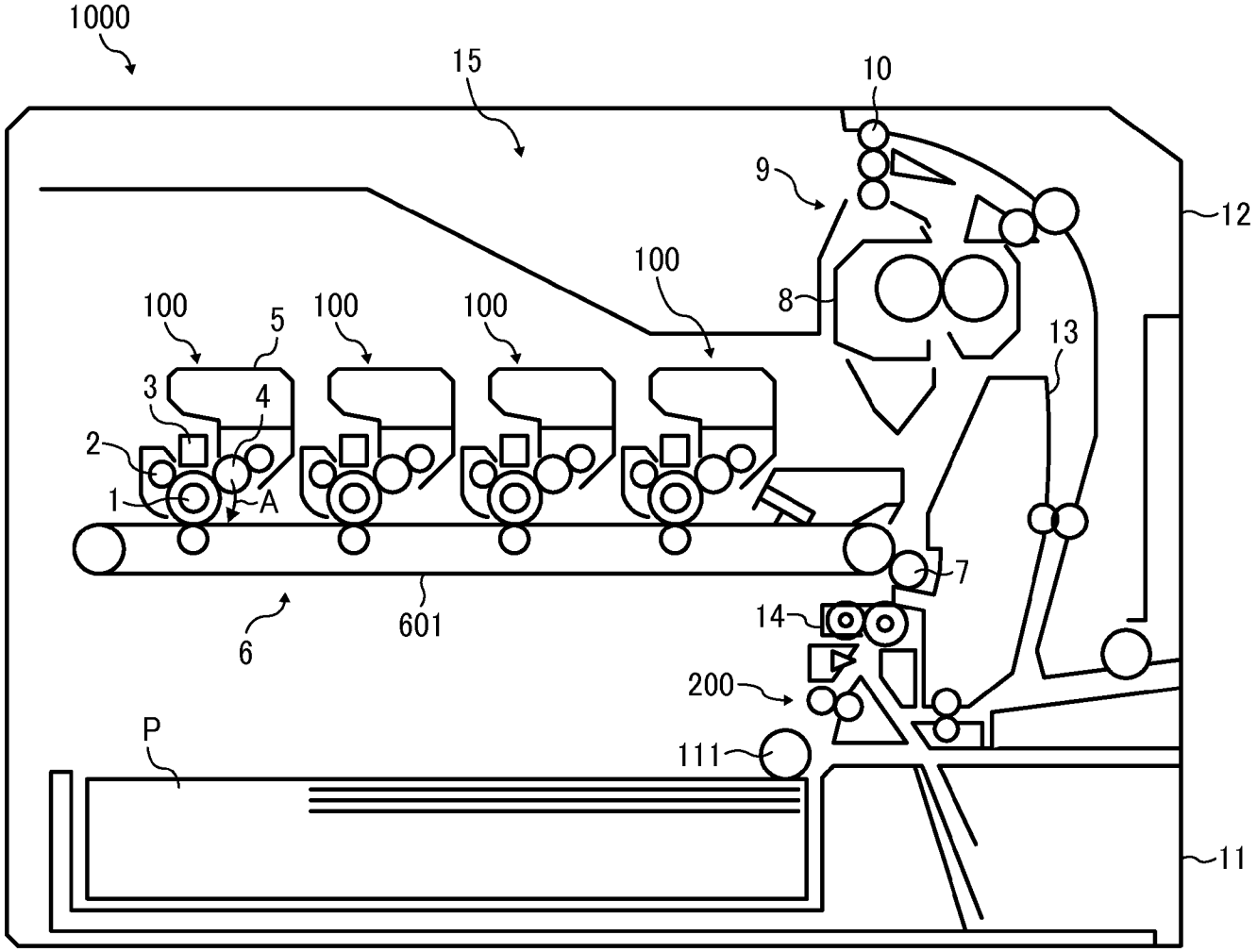
FIG. 2 is a cross sectional view illustrating a schematic internal configuration of the image forming apparatus of FIG. 1.

FIG. 2 illustrates a schematic internal configuration of the image forming apparatus 1000 of FIG. 1.

The image forming apparatus 1000 includes multiple image forming devices 100, each of which functions as an image forming part. It is to be noted that FIG. 2 illustrates four image forming devices 100 having the identical configuration to each other except toner colors, which are yellow (Y), magenta (M), cyan (C), and black (K). Each image forming device 100 includes a photoconductor 1 and an image forming components disposed around the photoconductor 1, which are a charger 2, an LED (light emitting diode) 3, a development unit 4, and a developer cartridge 5.

The photoconductor 1 is a cylindrical shaped image carrier that rotates in a direction indicated by arrow A in FIG. 2. The charger 2 uniformly charges a surface of the photoconductor 1. The LED 3 functions as a light source to form an electrostatic latent image on the surface of the photoconductor 1 by exposing the surface of the photoconductor 1 based on image data.

The development unit 4 is disposed adjacent to the LED 3 to develop the electrostatic latent image formed on the photoconductor 1 into a visible toner image with toner (developer). The developer cartridge 5 is disposed above the development unit 4 to accommodate the developer.

The image forming apparatus 1000 further includes an intermediate transfer unit 6, a transfer unit 7, a fixing device 8, a sheet discharging device 9, a reverse unit 10, and a duplex sheet conveying path 13.

The intermediate transfer unit 6 is disposed below the image forming devices 100 and includes an intermediate transfer belt 601 on which respective toner images formed on the corresponding photoconductors 1 are transferred and superimposed sequentially. The transfer unit 7 includes a transfer roller to transfer the composite toner image formed on the intermediate transfer unit 6 onto a sheet (a recording medium) P.

The fixing device 8 fixes the toner image transferred onto the sheet P. The sheet discharging device 9 discharges the sheet P to an outside of the image forming apparatus 1000. The reverse unit 10 conveys the sheet P to the duplex sheet conveying path 13 for duplex printing after a first face of the sheet P is printed. The sheet container 11 accommodates a sheet stack of the sheets P. The duplex sheet conveying path 13 is a path used for duplex printing to which the sheet P with the first face thereof printed is conveyed from the reverse unit 10.

A sheet feed roller 111, a relay roller pair 200, and a timing roller pair 14 are disposed between the sheet container 11 and the transfer unit 7.

The relay roller pair 200 and the timing roller pair 14 make the sheet P sagged at a position therebetween and convey the sheet P to the intermediate transfer belt 601 at a given timing. Doing so can accurately align a position of a toner image formed on the intermediate transfer belt 601 immediately before the toner image is transferred onto the sheet P.

The sheet P placed on top of the stack of the sheets P loaded on the sheet container 11 is fed from the sheet container 11 by the sheet feed roller 111 toward the relay roller pair 200. After passing between rollers of the relay roller pair 200, the sheet P is slackened off at the timing roller pair 14 that is stopped. Then, the sheet P is conveyed by the timing roller pair 14 at a given timing so that the toner image formed on the intermediate transfer belt 601 is transferred onto the sheet P. After passing the fixing device 8 and the sheet discharging device 9, the sheet P having the toner image thereon is discharged to the sheet discharging tray 15.

However, as a result of the trend of downsizing of image forming apparatus in recent years for better space efficiency, the sheet container might be greater in size than the apparatus body of the image forming apparatus depending on the size of the sheet used in the image forming apparatus. In this case, if the sheet container is attached to the apparatus body of the image forming apparatus, the sheet container protrudes form the apparatus body, which degrades space efficiency.

In order to address this inconvenience, sheet containers include an extension unit attached to a container body and pulled out from the container body according to the size of the sheet, which is known as an extendable and retractable sheet container. The extendable and retractable sheet container has a configuration in which the extension unit is slidably extended. This configuration can achieve a reduction in size of the installation area of an apparatus body of an image forming apparatus in accordance with the size of the sheet used by each user.

Figure 3A:
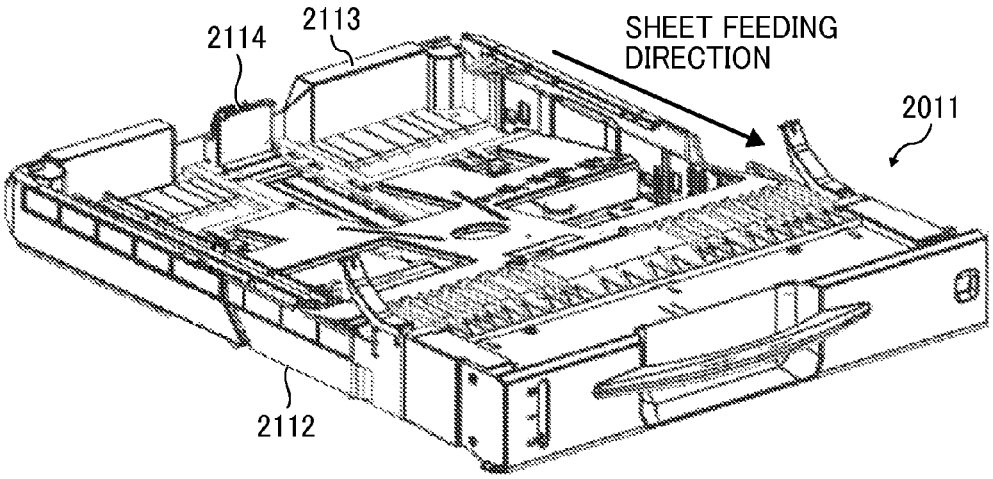
FIG. 3A is a perspective view illustrating a trailing end of a comparative sheet container with an extension unit retracted.
Figure 3B:
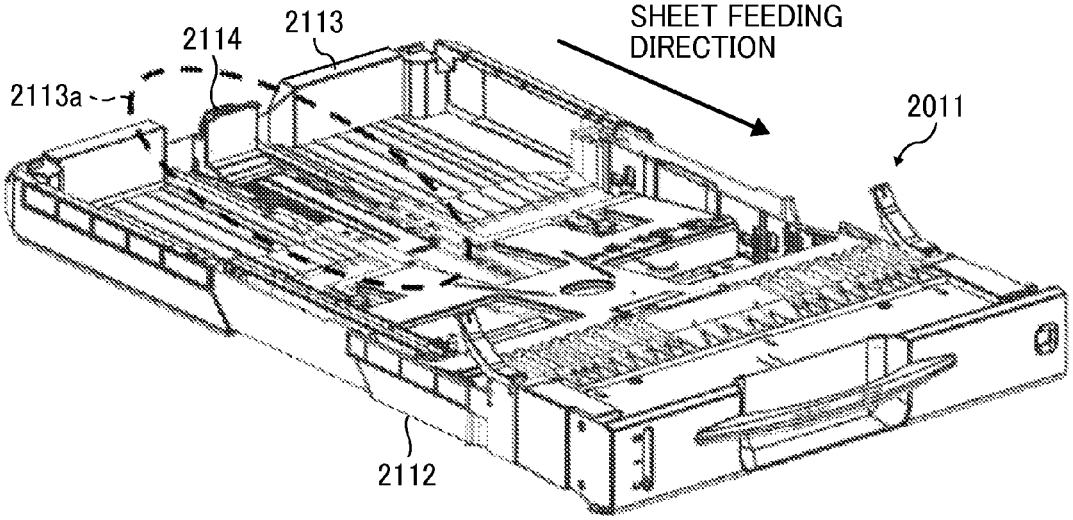
FIG. 3B is a perspective view illustrating the trailing end of the comparative sheet container with the extension unit extended.
Figure 4:
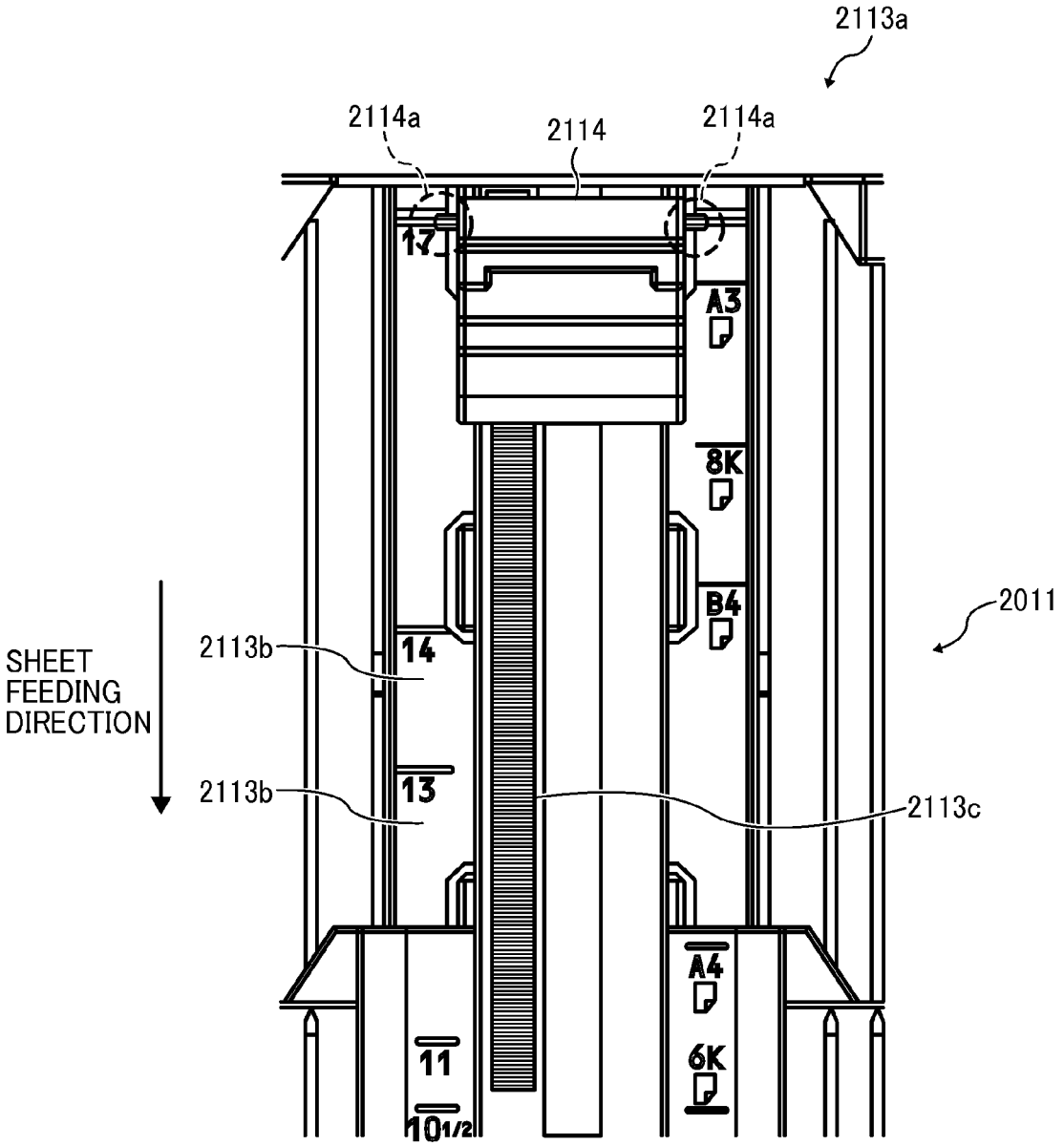
FIG. 4 is a plan view illustrating the trailing end of the comparative sheet container with the extension unit extended.

FIG. 3A illustrates the trailing end of an extendable and retractable sheet container 2011 as a comparative sheet container with an extension unit 2113 retracted. FIG. 3B illustrates the trailing end of the extendable and retractable sheet container with the extension unit extended at the maximum extension position. FIG. 4 is an extended plan view illustrating a sheet size indication area 2113*a* of an extension unit 2113.

The comparative sheet container 2011 includes a container body 2112, an extension unit 2113 that can be extended and retracted in a sheet feeding direction, and a sheet trailing end regulator 2114. The extendable extension unit 2113 includes the sheet size indication area 2113*a*, sheet size indicators 2113*b*, and grooves 2113*c*. The sheet trailing end regulator 2114 includes sheet size mark pointers (pointing arrows) 2114*a* to point a selected sheet size indicator 2113*b* of the sheet size indicators 2113*b*. The sheet size mark pointers 2114*a* are set to overlay the selected sheet size indicator 2113*b* to set the sheet trailing end regulator 2114. The sheet trailing end regulator 2114 can slide in an extending/retracting direction (i.e., the forward/backward direction) of the extension unit 2113 and can be stopped at any location of the grooves 2113*c* arranged serially along the extension unit 2113.

However, since the sheet size indicators 2113*b* indicating the sizes of the sheets are fixed to the extension unit 2113, the extension unit 2113 needs to be extended to the maximum extension position to position the sheet size indicators 2113*b* properly. When the extension unit 2113 is located at a position between a maximum extension position and a minimum retraction position, the sheet size indicators 2113*b* are not at the respective right positions. In this case, it is likely that a user sets the sheet trailing end regulator 2114 to an improper position at an in-between stop position of the extension unit 2113, and therefore a proper sheet feeding cannot be performed.

Specifically if the sheet trailing end regulator 2114 is set at a position that is smaller than the size of the sheet actually loaded on the comparative sheet container 2011, the leading end of the sheet abuts forcedly against the leading end of the container body 2112 to be bent. Doing so may cause misfeed by the sheet feed roller at a sheet separating part. By contrast, if the sheet trailing end regulator 2114 is set at a position that is greater than the size of the sheet, the leading end of the sheet does not reach the sheet feed roller, which may cause the misfeed. Accordingly, if the sheet trailing end regulator 2114 is not set at a correct position, it is not likely to feed the sheet properly.

Next, a description is given of a configuration and functions of the sheet container 11 according to an example of this disclosure with reference to FIGS. 5A through 10B.

The sheet container 11 includes a container body 112 and an extension unit 113.

The container body 112 of the sheet container 11 is detachably attached to the apparatus body 12 of the image forming apparatus 1000. The container body 112 has a flat loading face 112*f* on which the sheet P is loaded.

The extension unit 113 is extendable in a sheet feeding direction toward a rear end of the sheet container 11 with respect to the container body 112.

The extension unit 113 is disposed slidably extendable in a direction parallel to the loading surface of the container body 112, that is, in the sheet feeding direction of the container body 112.

A sheet trailing end regulator 114 is disposed at a center in a width direction of the extension unit 113 and slidably movable in a forward/backward direction of the extension unit 113, which is the sheet feeding direction. The sheet trailing end regulator 114 functions as a length regulator to position a trailing end of the sheet P to be loaded by abutting the trailing end of the sheet P.

A locking mechanism is disposed between the sheet trailing end regulator 114 and the extension unit 113 to engage the sheet trailing end regulator 114 at any desired sliding position on the loading face 112*f* of the container body 112. After the sheet is loaded on the sheet container 11, the sheet trailing end regulator 114 is slid and abut against the trailing end of the sheets P. Then, the locking mechanism is locked at the abutting position of the sheet P against the sheet trailing end regulator 114.

By so doing, the forward and backward positions of the sheets P are fixed. After the sheet container 11 is inserted into the apparatus body 12 of the image forming apparatus 1000 in this state, the sheet feed roller 111 contacts a leading end of an uppermost sheet P of the stack of sheets P, thereby making a sheet feeding operation ready to start.

FIGS. 5A through 7 illustrate the container body 112 with the extension unit 113 pulled out at a maximum position. In this state, the sheet P having a maximum size loadable to the image forming apparatus 1000 can be loaded.

Figure 5A:
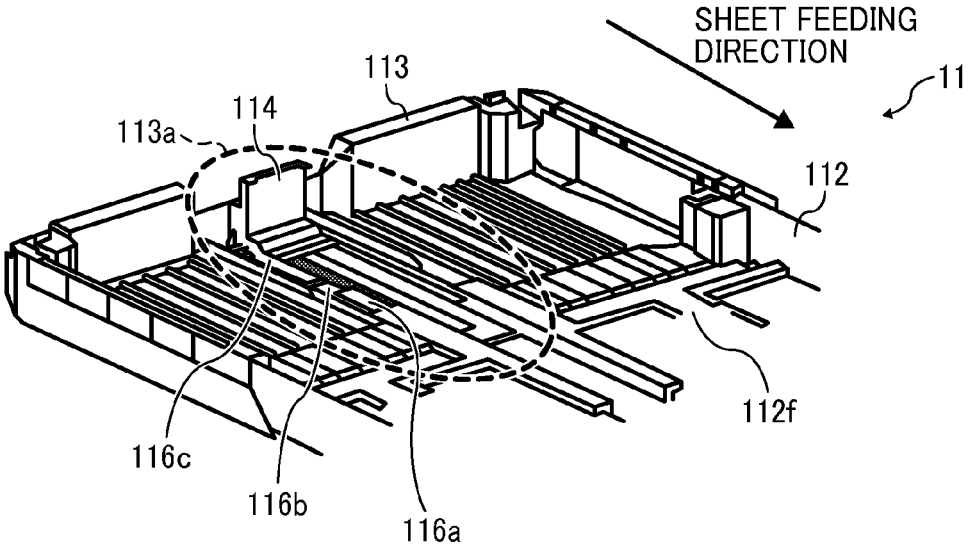
FIG. 5A is a perspective view illustrating a trailing end of the sheet container according to an example of this disclosure.
Figure 5B:
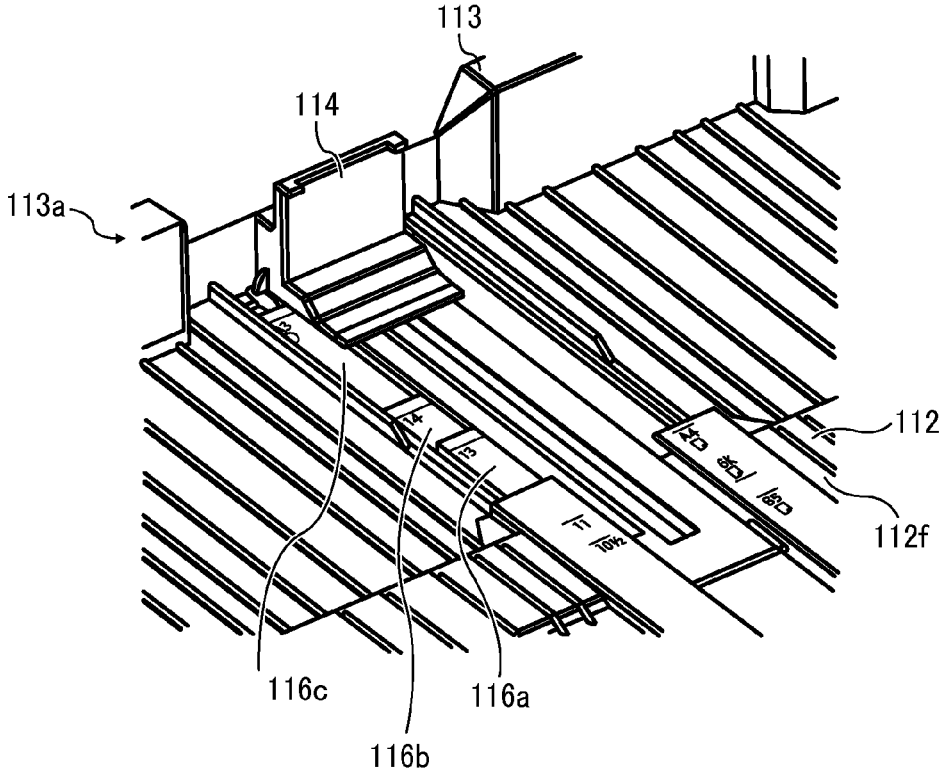
FIG. 5B is an enlarged perspective view illustrating the trailing end of the sheet container according to this example.
Figure 6:
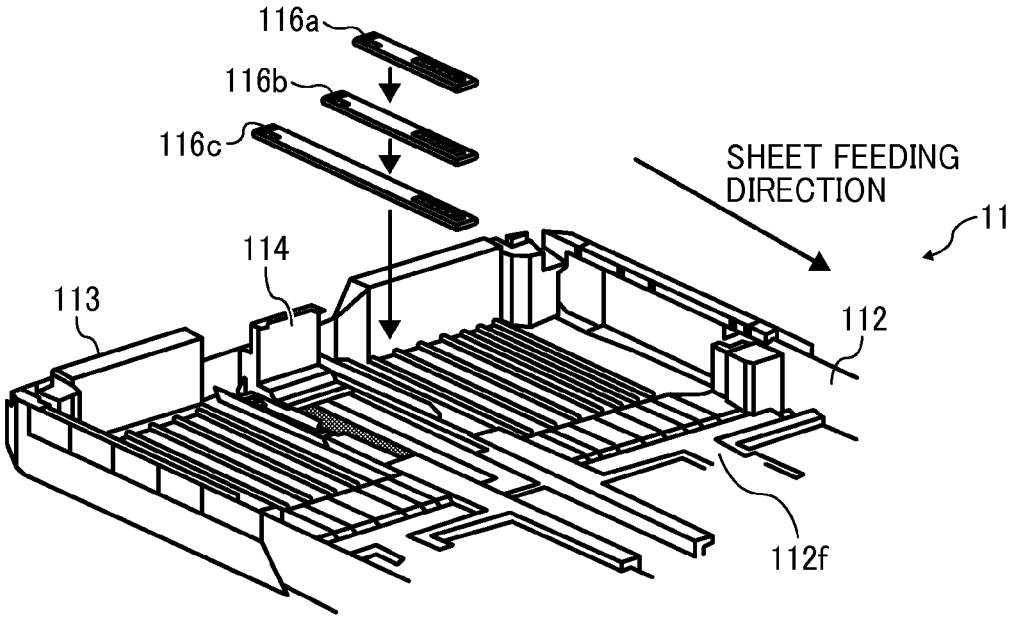
FIG. 6 is a perspective view illustrating the sheet container according to this example, in a state in which a sheet size indicator provided at the trailing end of the sheet container is removed.
Figure 7:
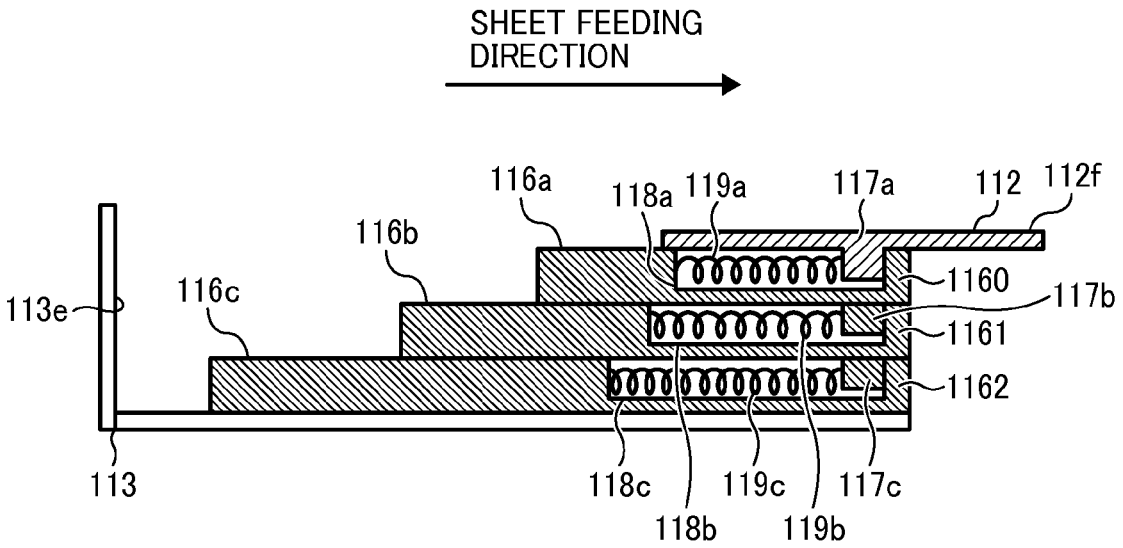
FIG. 7 is a cross sectional view illustrating the sheet container according to this example, in a state in which the sheet size indicator provided at the trailing end of the sheet container is attached.

FIG. 5A is a perspective view illustrating the extension unit 113. FIG. 5B is an enlarged perspective view illustrating a sheet size indication area 113*a* of the extension unit 113 of FIG. 5A. FIG. 6 illustrates the sheet container 11 with sheet size indicators 116*a*, 116*b*, and 116*c* removed from the extension unit 113. FIG. 7 is a cross sectional view illustrating a configuration of the sheet size indicators 116*a*, 116*b*, and 116*c*.

The sheet size indicators 116*a*, 116*b*, and 116*c* are strip-shaped members, each of which functions as a length regulator and extends from the container body 112 in a moving direction of the extension unit 113, which is the sheet feeding direction. Each of the sheet size indicators 116*a*, 116*b*, and 116*c* includes at least one sheet size mark that indicates the size of the sheet P to be loaded. In this example, each of the sheet size indicators 116*a*, 116*b*, and 116*c* includes a single sheet size mark different from the other sheet size indicators.

As illustrated in FIG. 7, the sheet container 11 according to this example includes the sheet size indicators 116*a*, 116*b*, and 116*c* in a multilayered manner. The sheet size indicators 116*a*, 116*b*, and 116*c* are disposed at a sliding part between the container body 112 and the extension unit 113.

The sheet size indicators 116*a*, 116*b*, and 116*c* include engagement parts 117*a*, 117*b*, and 117*c* and engagement grooves 118*a*, 118*b*, and 118*c*, respectively. The engagement grooves 118*a*, 118*b*, and 118*c* are provided extending in a longitudinal direction on the sheet size indicators 116*a*, 116*b*, and 116*c*, respectively. The engagement part 117*a* is disposed protruding downwardly from the container body 112 to be slidably engaged with the engagement groove 118*a* of the first sheet size indicator 116*a*. The engagement part 117*b* is disposed protruding downwardly from the sheet size indicator 116*a* to be slidably engaged with the engagement groove 118*b* of the second sheet size indicator 116*b*. The engagement part 117*c* is disposed protruding downwardly from the sheet size indicator 116*b* to be slidably engaged with the engagement groove 118*c* of the third sheet size indicator 116*c*.

Specifically, as illustrated in FIG. 7, the first sheet size indicator 116*a* is engaged with the engagement part 117*a* that is integrally attached to the container body 112 and the engagement groove 118*a* provided to the first sheet size indicator 116*a*. Further, the second sheet size indicator 116*b* disposed below the first sheet size indicator 116*a* is engaged with the engagement part 117*b* that is integrally attached to the first sheet size indicator 116*a* and the engagement groove 118*b* provided to the second sheet size indicator 116*b*.

The third sheet size indicator 116*c* disposed below the second sheet size indicator 116*b* at the lowest position is engaged with the engagement part 117*c* that is integrally attached to the second sheet size indicator 116*b* and the engagement groove 118*c* provided to the third sheet size indicator 116*c*. That is, the first sheet size indicator 116*a* is engaged with the container body 112 and the second sheet size indicator 116*b* and the third sheet size indicator 116*c* are engaged between two adjacent sheet size indicators of the sheet size indicators 116*a*, 116*b*, and 116*c*.

The engagement groove 118*a* of the sheet size indicator 116*a* disposed at the top position has a length shorter than the other engagement grooves 118*b* and 118*c*. As the position goes lower, the lengths of the engagement grooves 118*b* and 118*c* of the sheet size indicators 116*b* and 116*c* becomes longer. However, this order of the lengths depends on the sheet size and is not limited thereto. The sheet container 11 includes compression springs 119*a*, 119*b*, and 119*c*. The compression springs 119*a*, 119*b*, and 119*c* are disposed in the engagement grooves 118*a*, 118*b*, and 118*c*, respectively.

The sheet size indicators 116*a*, 116*b*, and 116*c* are extended from the container body 112. As the extension unit 113 is moved, a longitudinal length of the extension unit 113 with respect to the container body 112 varies.

FIG. 7 illustrates the sheet container 11 in a state in which the sheet size indicators 116*a*, 116*b*, and 116*c* are most extended. FIGS. 8A through 10B illustrate state of the sheet size indicators 116*a*, 116*b*, and 116*c* in the order of extension of the extension unit 113.

Figure 8A:
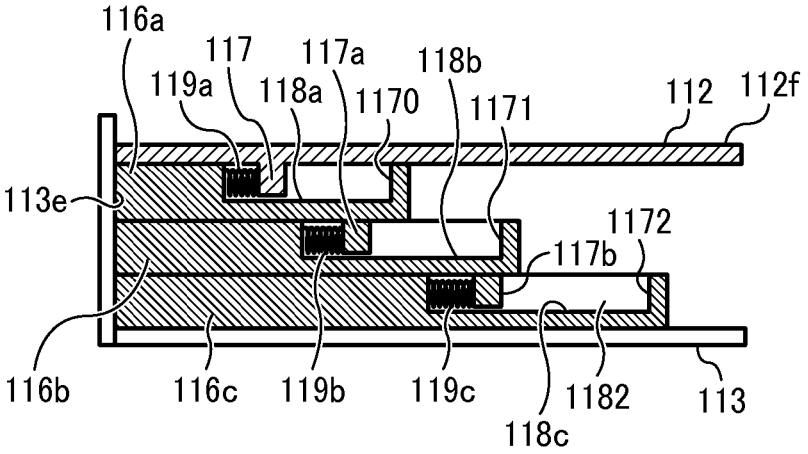
FIG. 8A is a cross sectional view illustrating the sheet container according to this example, in a state in which the sheet size indicator of the extension unit of the sheet container is at a shortest length.
Figure 8B:
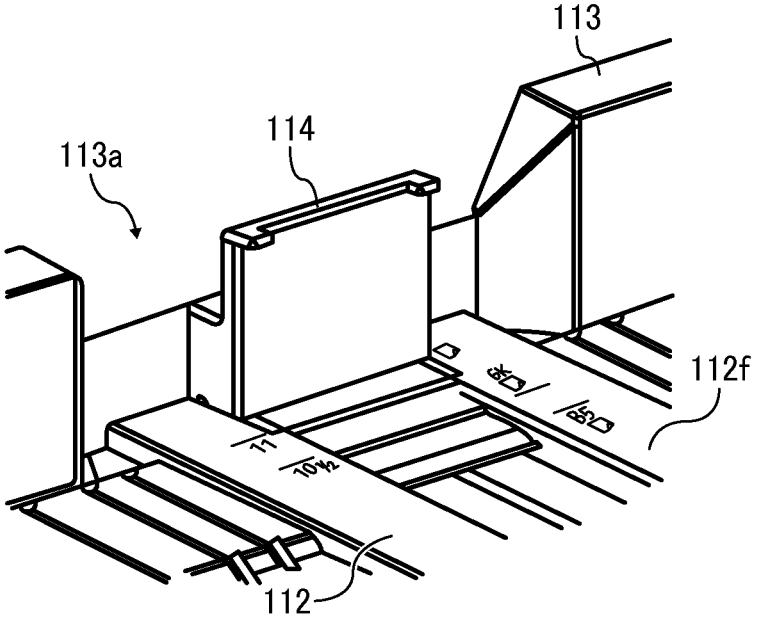
FIG. 8B is a perspective view illustrating the sheet container according to this example, in a state in which the sheet size indicator of the extension unit of the sheet container is at the shortest length.

Specifically, FIGS. 8A and 8B illustrate the sheet container 11 with the extension unit 113 retracted at a shortest length thereof. In this state, the sheet size indicators 116*a*, 116*b*, and 116*c* are not visible in FIG. 8B because the sheet size indicators 116*a*, 116*b*, and 116*c* are hidden below the container body 112. The compression springs 119*a*, 119*b*, and 119*c* are most compressed and respective rear ends of the sheet size indicators 116*a*, 116*b*, and 116*c* are in contact with a sheet size indicator contact face 113*e* that functions as a contact face that is an inner face of the rear end of the extension unit 113. Therefore, in the sheet size indicators 116*a*, 116*b*, and 116*c*, respective opposite sides of the compression springs 119*a*, 119*b*, and 119*c* with respect to the engagement parts 117*a*, 117*b*, and 117*c*, respectively, extend at a maximum length in the engagement grooves 118*a*, 118*b*, and 118*c*, respectively.

Figure 9A:
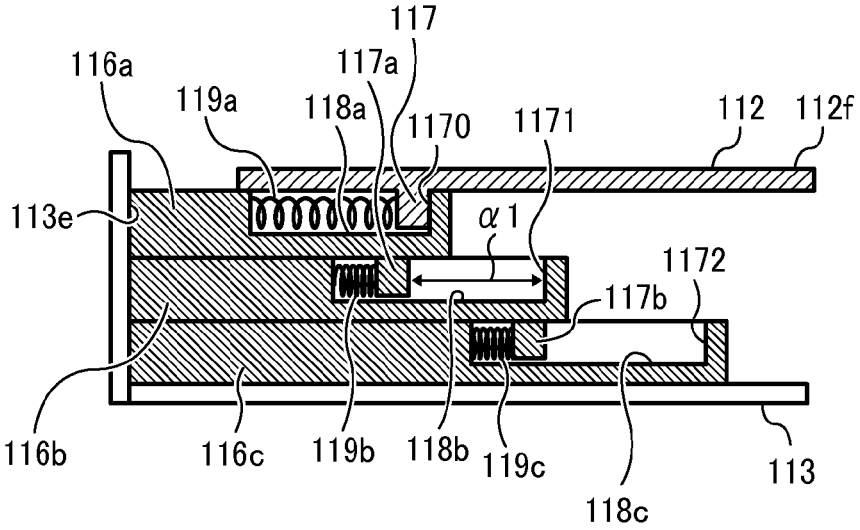
FIG. 9A is a cross sectional view illustrating the sheet container according to this example, in a state in which the sheet size indicator of the extension unit of the sheet container is at a first extension position.
Figure 9B:
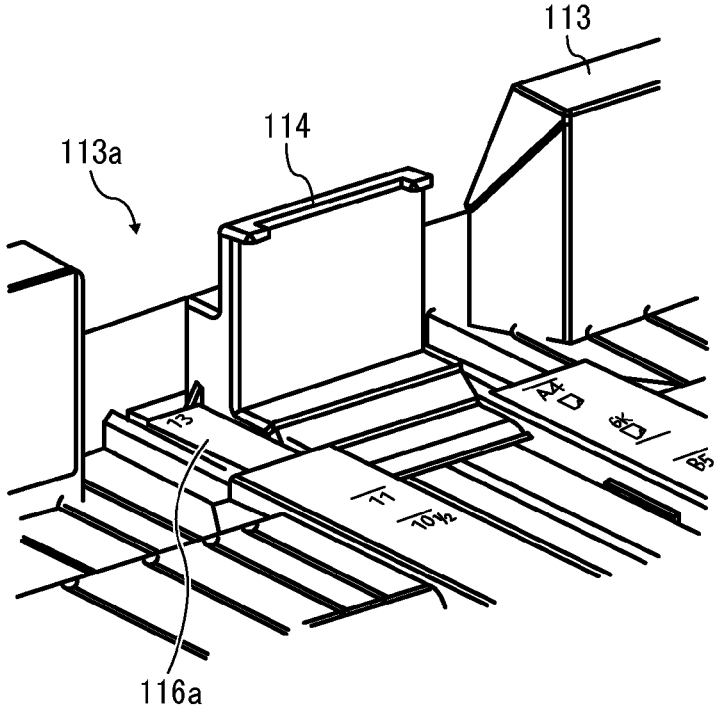
FIG. 9B is a perspective view illustrating the sheet container according to this example, in a state in which the sheet size indicator of the extension unit of the sheet container is at the first extension position.

FIGS. 9A and 9B illustrate the sheet container 11 with the extension unit 113 extended up to a position where the maximum containable paper size is 13 inch in the sheet feeding direction, which is a first extension position. In this state, the sheet size indicators 116*a*, 116*b*, and 116*c* are pressed by the compression springs 119*a*, 119*b*, and 119*c* and move along with the extension unit 113. Then, an upper face of the first sheet size indicator 116*a* that is on top of the sheet size indicators of the sheet container 11 is exposed in a range of from the sheet size indicator contact face 113*e* to a rear end of the container body 112. By so doing, the sheet size mark displayed on the upper face of the first sheet size indicator 116*a* becomes visible to a user.

The first sheet size indicator 116*a* disposed on top of the sheet size indicators of the sheet container 11 has the engagement groove 118*a* with the shortest length compared with the engagement grooves 118*b* and 118*c*, and therefore a downstream end wall 1170 of the engagement groove 118*a* contacts the engagement part 117*a* first. As a result, the position of the first sheet size indicator 116*a* with respect to the container body 112 is determined. This position is referred to as a "first stop position". Consequently, in the state in which the first sheet size indicator 116*a* is stopped in contact with the engagement part 117*a*, the sheet size mark on the upper face of the first sheet size indicator 116*a* is displayed at a correct position with the container body 112.

Thereafter, even if the extension unit 113 is further extended, the first sheet size indicator 116*a* disposed on top of the sheet size indicators of the sheet container 11 cannot move backward. By contrast, the sheet size indicators 116*b* and 116*c* have some lengths to downstream end walls 1171 and 1172, respectively, which are beyond the engagement part 117*a*. Accordingly, the sheet size indicators 116*b* and 116*c* further move along with extension of the extension unit 113.

Figure 10A:
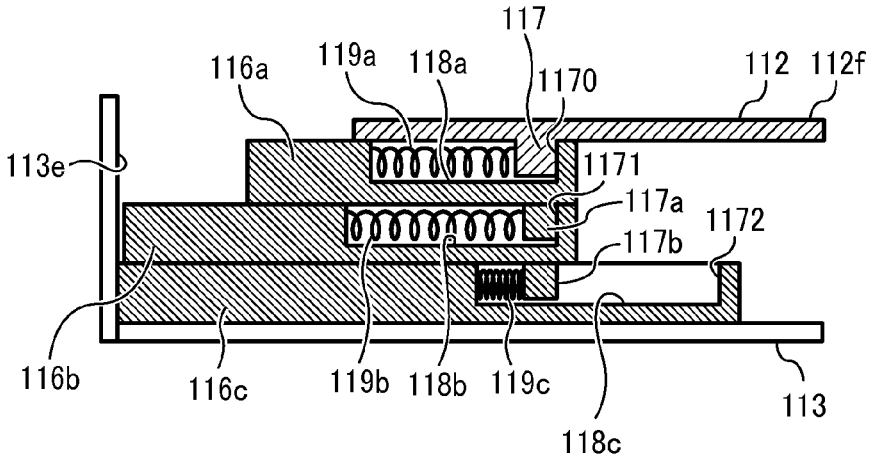
FIG. 10A is a cross sectional view illustrating the sheet container according to this example, in a state in which the sheet size indicator of the extension unit of the sheet container is at a second extension position.
Figure 10B:
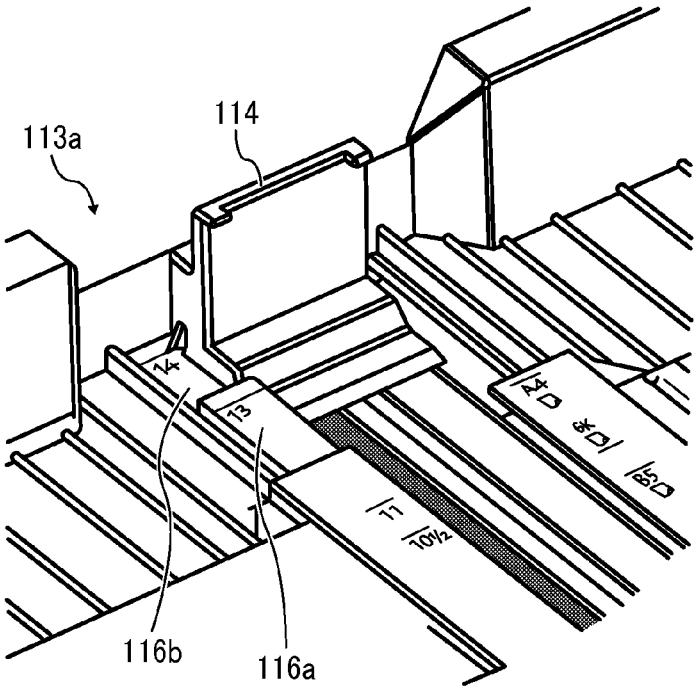
FIG. 10B is a perspective view illustrating the sheet container according to this example, in a state in which the sheet size indicator of the extension unit of the sheet container is at a second extension position.

FIGS. 10A and 10B illustrate the sheet container 11 with the extension unit 113 extended up to a position where the maximum containable paper size is 14 inch in the sheet feeding direction, which is a second extension position. In this state, the downstream end wall 1171 of the engagement groove 118*b* of the second sheet size indicator 116*b* contacts the engagement part 117*b* of the first sheet size indicator 116*a* that remains stopped. Therefore, in addition to the first sheet size indicator 116*a*, the second sheet size indicator 116*b* is stopped. Thereafter, even if the extension unit 113 is further extended, the second sheet size indicator 116*b* in addition to the first sheet size indicator 116*a* cannot move backward. This position is referred to as a "second stop position". Then, an upper face of the second sheet size indicator 116*b* is exposed in a range of from the front end of the first sheet size indicator 116*a* to the rear end of the container body 112. By so doing, the sheet size mark displayed on the upper face of the second sheet size indicator 116*b* becomes visible to the user.

As the extension unit 113 is further extended, the positions of the sheet size indicators 116*a*, 116*b*, and 116*c* change from the state as illustrated in FIGS. 10A and 10B to the state as illustrated in FIG. 7. In the state of the sheet container 11 as illustrated in FIG. 7, the downstream end wall 1172 of the engagement groove 118*c* of the third sheet size indicator 116*c* contacts the engagement part 117*c* of the second sheet size indicator 116*b* that remains stopped. Therefore, in addition to the first sheet size indicator 116*a* and the second sheet size indicator 116*b*, the third sheet size indicator 116*c* is stopped. Thereafter, even if the extension unit 113 is further extended, the third sheet size indicator 116*c* in addition to the first sheet size indicator 116*a* and the second sheet size indicator 116*b* cannot move backward. This position is referred to as a "third stop position".

As described above, the sheet size indicators 116*a*, 116*b*, and 116*c* can be positioned accurately even when the extension unit 113 is extended to the maximum length and retracted to the minimum length. With this configuration, the user can move the sheet trailing end regulator 114 to a proper position easily, and therefore a proper sheet feeding operation can be performed. Further, this simple configuration of the sheet container 11 can show proper positions of various paper sizes without employing any sensor or detector. Therefore, the cost of parts can be reduced.

As can be seen from FIGS. 9A and 9B, by disposing the engagement part 117*b* on the first sheet size indicator 116*a*, a distance $\alpha 1$ between the downstream end wall 1171 and the engagement part 117*b* in the engagement groove 118*b* of the second sheet size indicator 116*b* is equal to or greater than a length of difference between a size (a length) indicted by the sheet size mark of the first sheet size indicator 116*a* and a size (a length) indicted by the sheet size mark of the second sheet size indicator 116*b*. Similarly, a distance between the downstream end wall 1172 and the engagement part 117*c* in the engagement groove 118*c* of the third sheet size indicator 116*c* is equal to or greater than a length of difference between a size (a length) indicted by the sheet size mark of the second sheet size indicator 116*b* and a size (a length) indicted by the sheet size mark of the third sheet size indicator 116*c*.

As described above, this example describes the configuration that includes the compression springs 119*a*, 119*b*, and 119*c* functioning as biasing members or rear end biasing members to bias the sheet size indicators 116*a*, 116*b*, and 116*c* to the sheet size indicator contact face 113*e* that is an inner face at the rear end of the extension unit 113. By contacting the downstream end walls 1170, 1171, and 1172 of the engagement grooves 118*a*, 118*b*, and 118*c* in the sheet feeding direction with the engagement parts 117*a*, 117*b*, and 117*c*, the sheet size indicators 116*a*, 116*b*, and 116*c* remain stopped at the respective stop positions when the extension unit 113 is extended. The downstream end walls 1170, 1171, and 1172 function as engagement targets with respect to the engagement parts 117*a*, 117*b*, and 117*c*, respectively.

It is to be noted that the same effect can be achieved by a configuration without the biasing members (i.e., the compression springs 119*a*, 119*b*, and 119*c*) or a configuration in which the sheet size indicator contact face 113*e* of the extension unit 113 is magnetically connected to respective upstream end portions in the sheet feeding direction of the sheet size indicators 116*a*, 116*b*, and 116*c*. By so doing, the sheet size indicators 116*a*, 116*b*, and 116*c* can be moved to respective precise positions reliably when the extension unit is extended and retracted. Consequently, the user can move the sheet trailing end regulator 114 to the proper position easily, and therefore the proper sheet feeding operation can be performed.

As illustrated in FIG. 7, the sheet size indicators 116*a*, 116*b*, and 116*c* can be abutted (pressed) against the extension unit 113 by biasing respective downstream end parts 1160, 1161, and 1162 of the sheet size indicators 116*a*, 116*b*, and 116*c* in the sheet feeding direction, respectively. However, since the configuration of the above-described example includes the biasing members 119*a*, 119*b*, and 119*c* in the engagement groove 118*a*, 118*b*, and 118*c*, respectively, space to attach the biasing members 119*a*, 119*b*, and 119*c* can be eliminated.

Figure 11:
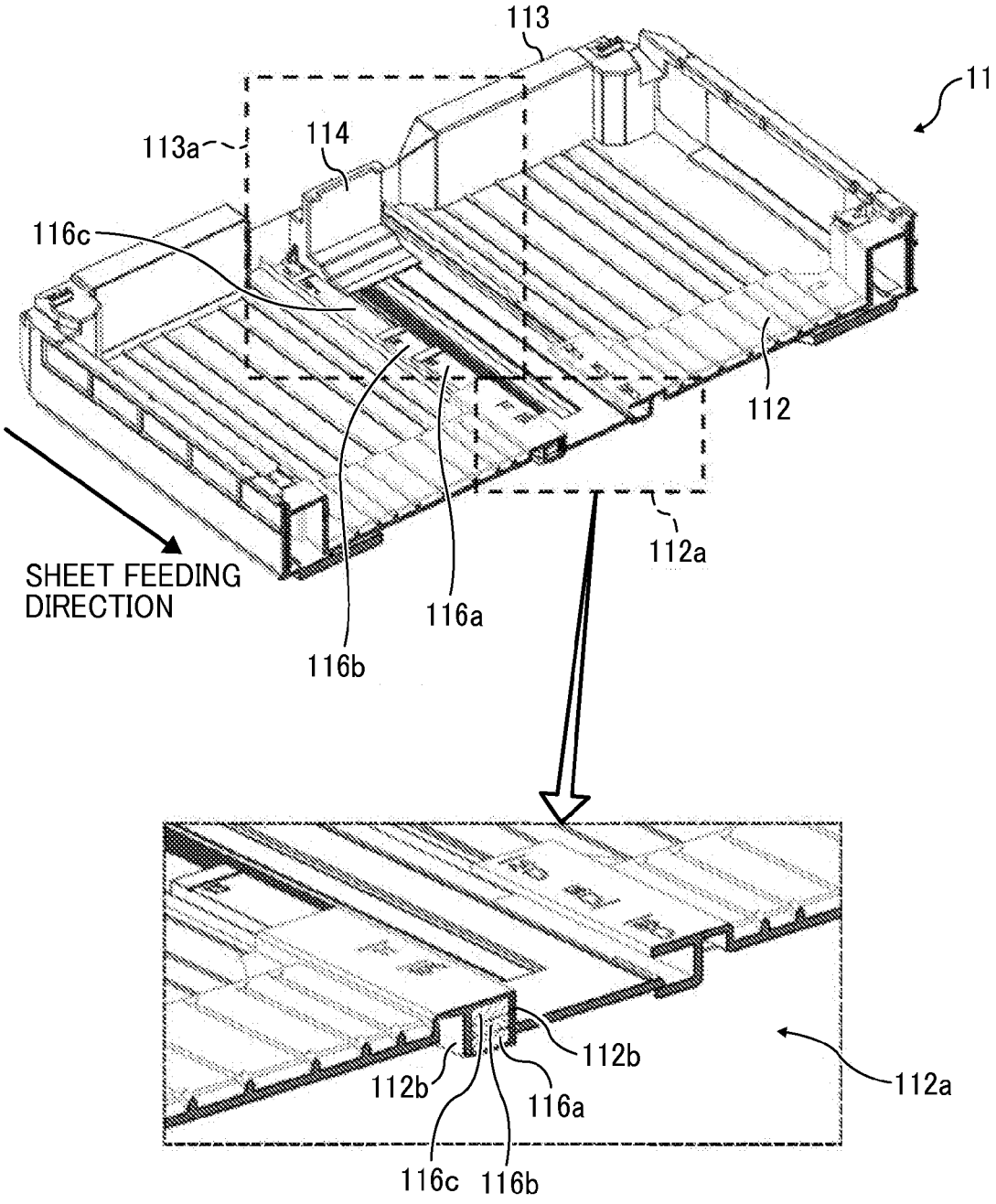
FIG. 11 is a perspective view illustrating a cross section of a rear half of the sheet container according to another example of this disclosure.
Figure 12:
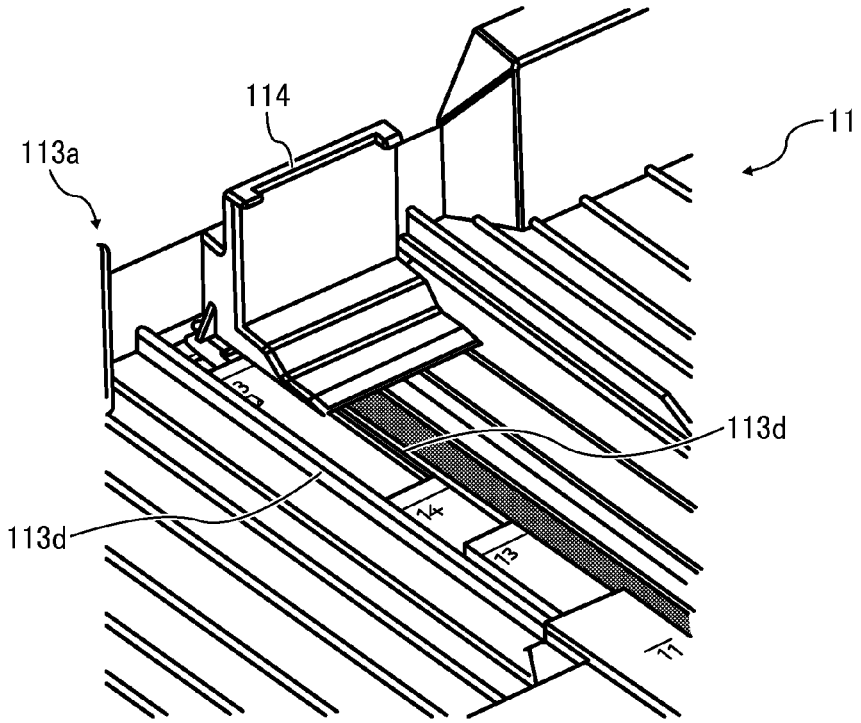
FIG. 12 is a perspective view illustrating the extension unit of the rear half of the sheet container according to this example.

Next, a description is given of a configuration and functions of the sheet container 11 according to another example of this disclosure with reference to FIGS. 11 and 12.

FIG. 11 is a cross sectional view of a rear half of the sheet container 11 according to the present example, so that the sheet size indicators 116*a*, 116*b*, and 116*c* are disposed in the multilayered manner between the container body 112 and the extension unit 113, with an enlarged view of a cross section 112*a* additionally attached. FIG. 12 illustrates an enlarged view of the sheet size indication area 113*a* of the extension unit 113.

As illustrated in FIG. 11, the sheet size indicators 116*a*, 116*b*, and 116*c* of the sheet container 11 according to the present example are disposed in the multilayered manner and a sheet width direction regulator 112*b* that is disposed in the container body 112 regulates the sheet size indicators 116*a*, 116*b*, and 116*c* in the sheet width direction. Accordingly, by preventing displacement of the sheet size indicators 116*a*, 116*b*, and 116*c* in the sheet width direction, the sheet size indicators 116*a*, 116*b*, and 116*c* do not get caught with the container body 112 or other sheet size indicator(s) when the extension unit 113 is extended and retracted with respect to the container body 112. Therefore, the operability of the extension unit 113 is not degraded.

As illustrated in FIG. 12, the sheet size indicators 116*a*, 116*b*, and 116*c* disposed in the multilayered manner are restricted in the sheet width direction by a sheet width direction regulator 113*d* that is disposed on the extension unit 113. By so doing, this configuration illustrated in FIG. 12 can achieve the same effect as described with reference to FIG. 11. Specifically, if displacement of the sheet size indicator (i.e., the sheet size indicators 116*a*, 116*b*, and 116*c*) in the sheet width direction can be prevented, the sheet size indicators 116*a*, 116*b*, and 116*c* do not get caught with the container body 112 or other sheet size indicator(s) when the extension unit 113 is extended and retracted with respect to the container body 112. Therefore, degradation of the operability of the extension unit 113 can be prevented.

It is to be noted that the sheet container 11 according to the present example can include both the sheet width direction regulator 112*b* illustrated in FIG. 11 and the sheet width direction regulator 113*d* illustrated in FIG. 12. With this configuration, the displacement of the sheet size indicator (i.e., the sheet size indicators 116*a*, 116*b*, and 116*c*) in the sheet width direction can be prevented more reliably. Therefore, when the extension unit 113 is extended and retracted with respect to the container body 112, the sheet size indicators 116*a*, 116*b*, and 116*c* do not get caught with the container body 112 or other sheet size indicator(s). As a result, degradation of the operability of the extension unit 113 can be prevented more reliably.

Figure 13:
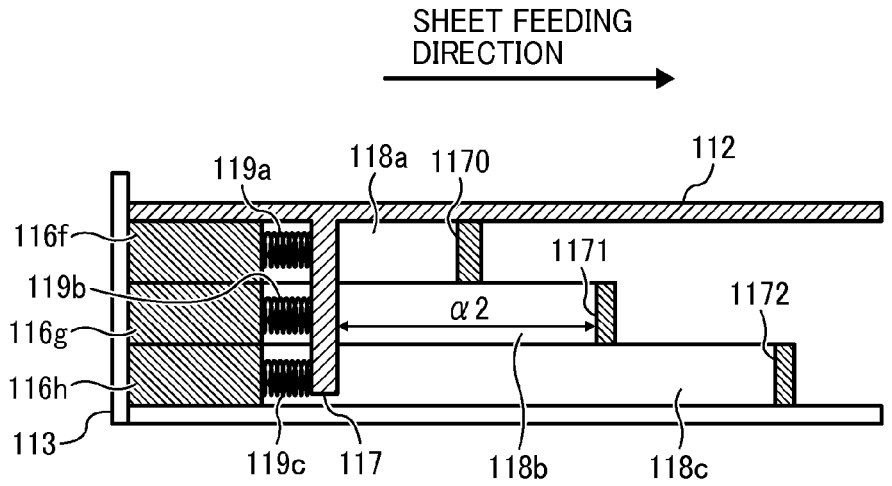
FIG. 13 is a cross sectional view illustrating the sheet container according to yet another example of this disclosure, in a state in which the sheet size indicator of the extension unit is at the shortest length.
Figure 14A:
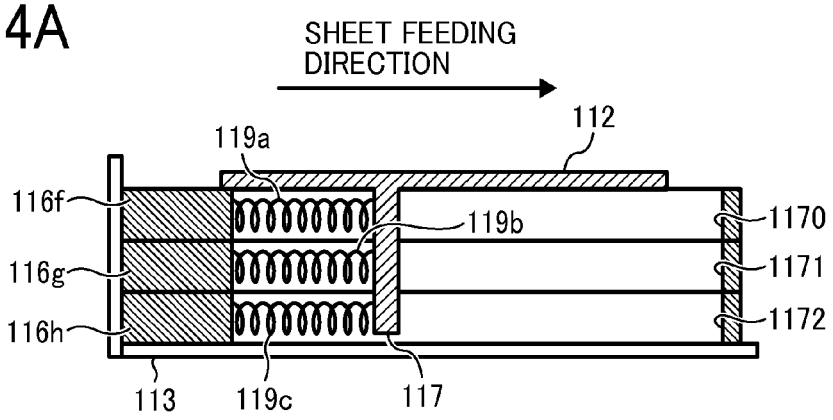
FIG. 14A is a cross sectional view illustrating the sheet container according to this example, in a state in which the sheet size indicator of the extension unit of the sheet container is at a first extension position.
Figure 14B:
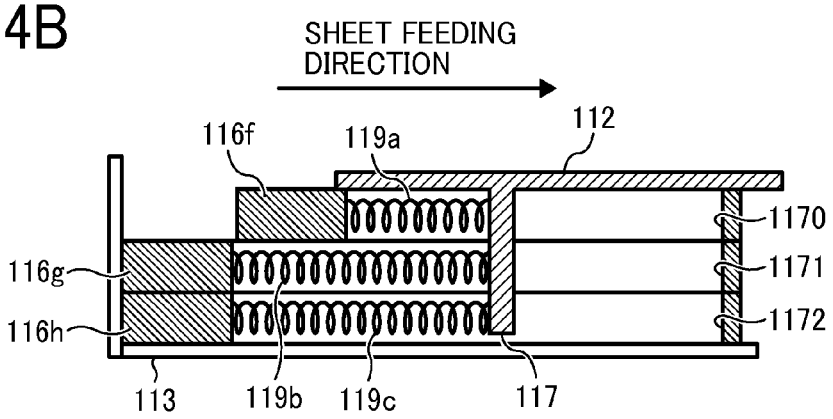
FIG. 14B is a cross sectional view illustrating the sheet container according to this example, in a state in which the sheet size indicator of the extension unit of the sheet container is at the second extension position.
Figure 14C:
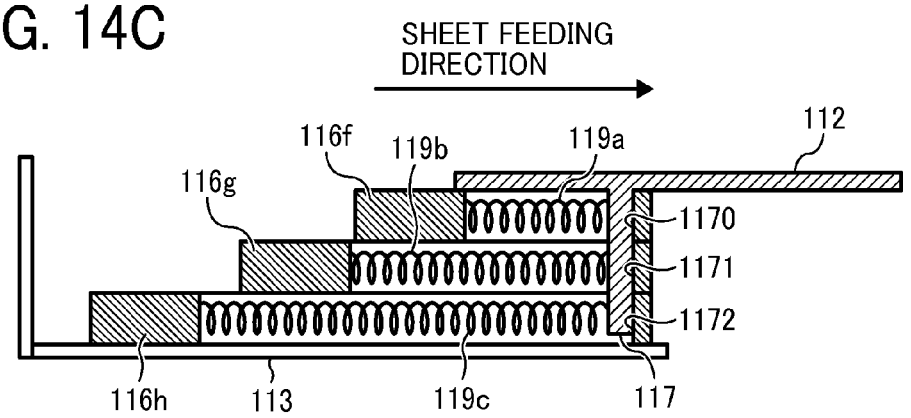
FIG. 14C a cross sectional view illustrating the sheet container according to this example, in a state in which the sheet size indicator of the extension unit of the sheet container is at a maximum extension position.

Next, a description is given of a configuration and functions of the sheet container 11 according to yet another example of this disclosure with reference to FIGS. 13 and 14C.

Specifically, FIG. 13 illustrates a state of the sheet size indicators 116*f*, 116*g*, and 116*h* of the sheet container 11 when the extension unit 113 is retracted at a shortest length thereof. In this state, the sheet size indicators 116*f*, 116*g*, and 116*h* are not visible because the sheet size indicators 116*f*, 116*g*, and 116*h* are hidden below the container body 112.

Further, FIGS. 14A through 14C illustrate states of the sheet size indicators 116*f*, 116*g*, and 116*h* in the order of extension of the extension unit 113. Specifically, FIG. 14A illustrates a state in which the sheet size indicators 116*f*, 116*g*, and 116*h* is at the first extension position, FIG. 14B illustrates a state in which the sheet size indicators 116*f*, 116*g*, and 116*h* is at the second extension position, and FIG. 14C illustrates a state in which the sheet size indicators 116*f*, 116*g*, and 116*h* is at the maximum extension position.

As illustrated in FIG. 13, the sheet container 11 according to this present example has a configuration in which the sheet size indicators 116*f*, 116*g*, and 116*h* are engaged with a common engagement part 117 that is integrally attached to the container body 112 and functions as a common engagement part to the sheet size indicators 116*f*, 116*g*, and 116*h*. That is, the sheet size indicators 116*f*, 116*g*, and 116*h* respectively have the grooves 118*f*, 118*g*, and 118*h*. Each of the grooves 118*f*, 118*g*, and 118*h* are vertically penetrated, so that the common engagement part 117 is inserted through the grooves 118*f*, 118*g*, and 118*h* in a vertical direction.

The sheet size indicators 116*f*, 116*g*, and 116*h* are positioned with the aid of the common engagement part 117 of the container body 112. Once the sheet size indicators 116*f*, 116*g*, and 116*h* are positioned, respective lengths of the sheet size indicators 116*f*, 116*g*, and 116*h* in the sheet feeding direction are determined. Consequently, any order in sheet size combination of the sheet size indicators 116*f*, 116*g*, and 116*h* can be applied, and therefore the user can obtain any desired combination of the sheet size indicators 116*f*, 116*g*, and 116*h*.

As a result, the operation of the sheet container 11 can be more customizable. Further, a structure of the sheet size indicator can be simpler with no projecting part, and therefore the cost of parts can be reduced.

In FIG. 13, a distance α2 between the downstream end wall 1171 and the common engagement part 117 in the engagement groove 118*b* of the second sheet size indicator 116*g* equals to at least a length of the engagement groove 118*a* of the first sheet size indicator 116*f* plus a length of difference between a size (a length) indicated by the sheet size mark of the first sheet size indicator 116*f* and a size (a length) indicated by the sheet size mark of the second sheet size indicator 116*g*. Similarly, a distance between the downstream end wall 1172 and the common engagement part 117 in the engagement groove 118*c* of the third sheet size indicator 116*h* equals to at least the length of the engagement groove 118*b* of the second sheet size indicator 116*g* plus a length of difference between a size (a length) indicated by the sheet size mark of the second sheet size indicator 116*g* and a size (a length) indicated by the sheet size mark of the third sheet size indicator 116*h*. Accordingly, as the position of the sheet size indicator becomes lower, the length of the sheet size indicator becomes longer.

Figure 15:
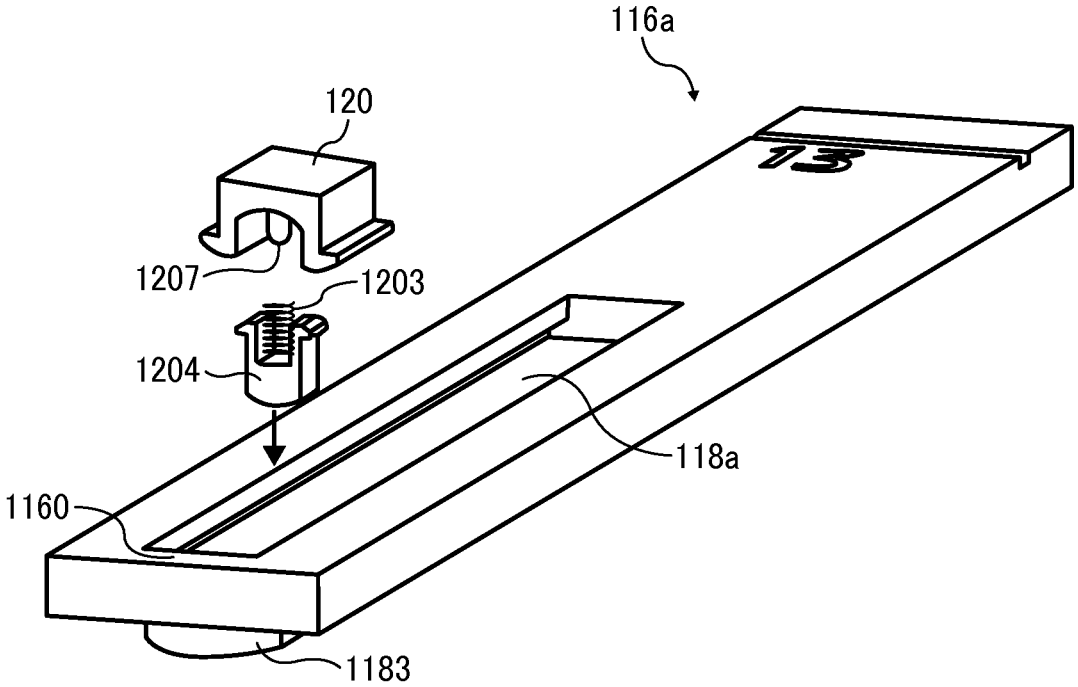
FIG. 15 is a perspective view illustrating a guide member to guide the sheet size indicator of the sheet container according to yet another example of this disclosure.
Figure 17A:
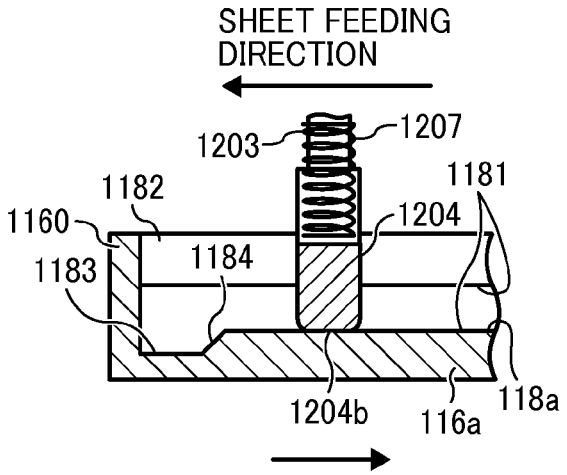
FIG. 17A is a cross sectional view illustrating the guide member to guide the sheet size indicator of the sheet container according to this example, in a state in which the sheet size indicator is moving.
Figure 17B:
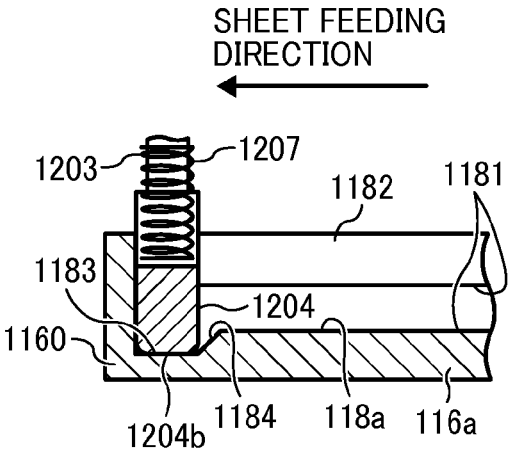
FIG. 17B is a cross sectional view illustrating the guide member to guide the sheet size indicator of the sheet container according to this example, in a state in which the sheet size indicator is stopped.

Next, a description is given of a configuration and functions of the sheet container 11 according to yet another example of this disclosure with reference to FIGS. 15 and 17B.

The sheet container 11 according to this example includes guide members for the sheet size indicators 116*a*, 116*b*, 116*c*, 116*f*, 116*g*, and 116*h*. The sheet size indicators 116*a*, 116*b*, 116*c*, 116*f*, 116*g*, and 116*h* are slidable, and therefore the guide members are provided to stabilize movements of the sheet size indicators 116*a*, 116*b*, 116*c*, 116*f*, 116*g*, and 116*h*.

The sheet container 11 according to this example includes an engagement projection 120 that functions as a guide member to guide, for example, the sheet size indicator 116*a* that indicates the size of the 13-inch sheet P. The engagement projection 120 is slidably engaged with the engagement groove 118*a* of the sheet size indicator 116*a*. The engagement projection 120 is supported by an extension portion of the container body 112.

The engagement projection 120 can also function as an the engagement part, which is similar to the engagement part 117*a* as illustrated in FIG. 7 to stop movement of the sheet size indicator 116*a*. It is to be noted that, similar to the sheet size indicator 116*a* that indicates the size of the 13-inch sheet P, the other sheet size indicators 116*b*, 116*c*, 116*f*, 116*g*, and 116*h* can also be slidably guided by the corresponding engagement projection 120.

The engagement projection 120 includes a pair of symmetrical claws 1201. The pair of symmetrical claws 1201 slides between and a pair of vertical regulators 1181 provided to the engagement groove 118*a* of the sheet size indicator 116*a*, so as to be engaged with the sheet size indicator 116*a*. Further, side faces 1202 disposed facing opposite to each other (left and right) at a root side of the pair of symmetrical claws 1201 are slidably held between a pair of lateral regulators 1182 that is disposed facing opposite to each other (left and right) of the engagement groove 118*a* of the sheet size indicator 116*a*.

Thus, the engagement projection 120 regulates the sheet size indicator 116*a* vertically and laterally. Vertical and lateral regulations of the sheet size indicator 116*a* by the engagement projection 120 can eliminate or reduce a regulation part or an engagement part to guide the sheet size indicator 116*a* to the container body 112 and the extension unit 113. By so doing, the cost of parts can be reduced.

Further, the engagement projection 120 includes a click member 1204 that is biased downwardly by a compression spring 1203 that functions as a biasing member or a projecting part biasing member. The click member 1204 includes a pair of legs 1204*a* disposed laterally (left and right) at an upper end thereof. The pair of legs 1204*a* is contained in a pair of engagement recessed parts 1205 in a vertically movable manner.

A pair of projecting parts 1206 is provided at an entrance of the pair of engagement recessed parts 1205. The pair of projecting parts 1206 functions as a retaining member to prevent the pair of legs 1204*a* coming off or disengaging from the engagement projection 120. The compression spring 1203 is inserted into the engagement projection 120 to surround (an outer circumference of) a shaft 1207 of the engagement projection 120.

Figure 16A:
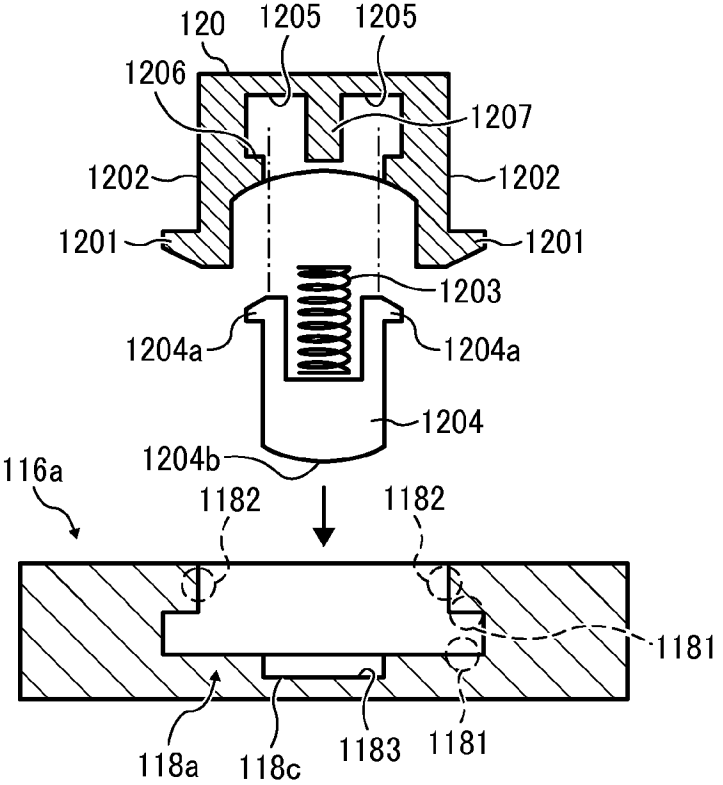
FIG. 16A is a cross sectional view illustrating the guide member before assembly to guide the sheet size indicator of the sheet container according to this example.
Figure 16B:
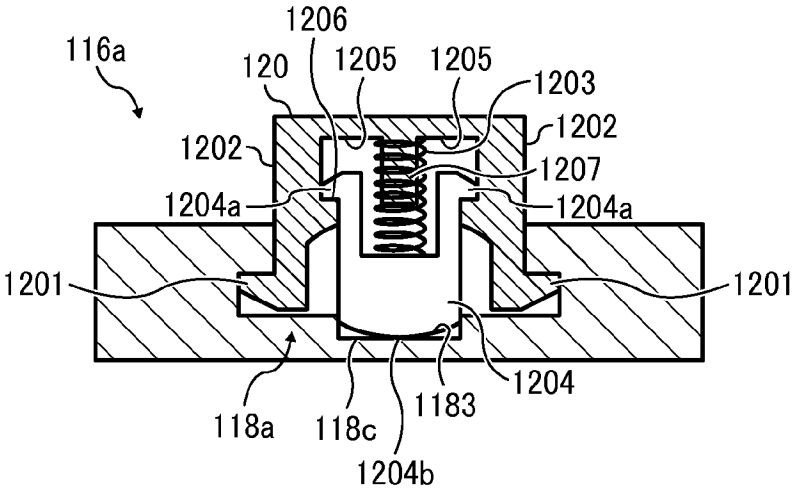
FIG. 16B is a cross sectional view illustrating the guide member after assembly to guide the sheet size indicator of the sheet container according to this example.

A lower end of the click member includes an arc-shaped engagement projecting part 1204*b*. As illustrated in FIGS. 16B and 17B, when the sheet size indicator 116*a* extends to the maximum extension position, the engagement projecting part 1204*b* is engaged with a click with an engagement recessed part 1183 that is provided on a bottom face at the downstream end part 1160 (in the sheet feeding direction) of the engagement groove 118*a* of the sheet size indicator 116*a*. A rim of the engagement recessed part 1183 has a tapered face 1184 that slides toward the bottom face of the engagement groove 118*a* so that the engagement projecting part 1204*b* can ride on the bottom face of the engagement groove 118*a* with a greater horizontal force than a given value.

As the extension unit 113 is extended from the container body 112, the sheet size indicator 116*a* moves from a state illustrated in FIG. 17A to a state illustrated in FIG. 17B. At this time, the compression spring 1203 presses the click member 1204 of the engagement projection 120, so that the click member 1204 slides on the engagement groove 118*a* of the sheet size indicator 116*a* to fit with the engagement recessed part 1183 with a click sound or feeling. The click feeling enables the user to easily confirm that the sheet size indicator 116*a* is moved to a proper position. Accordingly, when the extension unit 113 is pulled out, the sheet size indicator 116*a* can be facilitated to stop at the proper position.

The click member 1204 used in the configuration according to this example is a part separated from the engagement projection 120. However, this configuration is not limited thereto. For example, the click member 1204 can be integrated to the engagement projection 120. When the click member 1204 is integrated to the engagement projection 120, part of engagement projection 120 can be modified to a thin elastic part to remove the compression spring 1203.

However, since the engagement projecting part 1204*b* of the click member 1204 slides on a sliding portion of the engagement groove 118*a*, the engagement projecting part 1204*b* can easily be worn. The click member 1204 according to this example is provided as a different member separate from the engagement projection 120, thereby facilitating replacement of the click member 1204 due to abrasion of the click member 1204.

Further, the compression spring 1203 presses the click member 1204 that is provided as a different member from the engagement projection 120. By so doing, when the click member 1204 is not fitted into the engagement recessed part 1183, the click member 1204 is retracted in a direction opposite to a pressing direction. With this action, wear of the click member 1204 and of the sliding portion of the engagement groove 118*a* can be reduced.

Next, a description is given of a configuration and functions of the sheet container 11 according to yet another example of this disclosure with reference to FIGS. 18A through 18E.

Figure 18A:
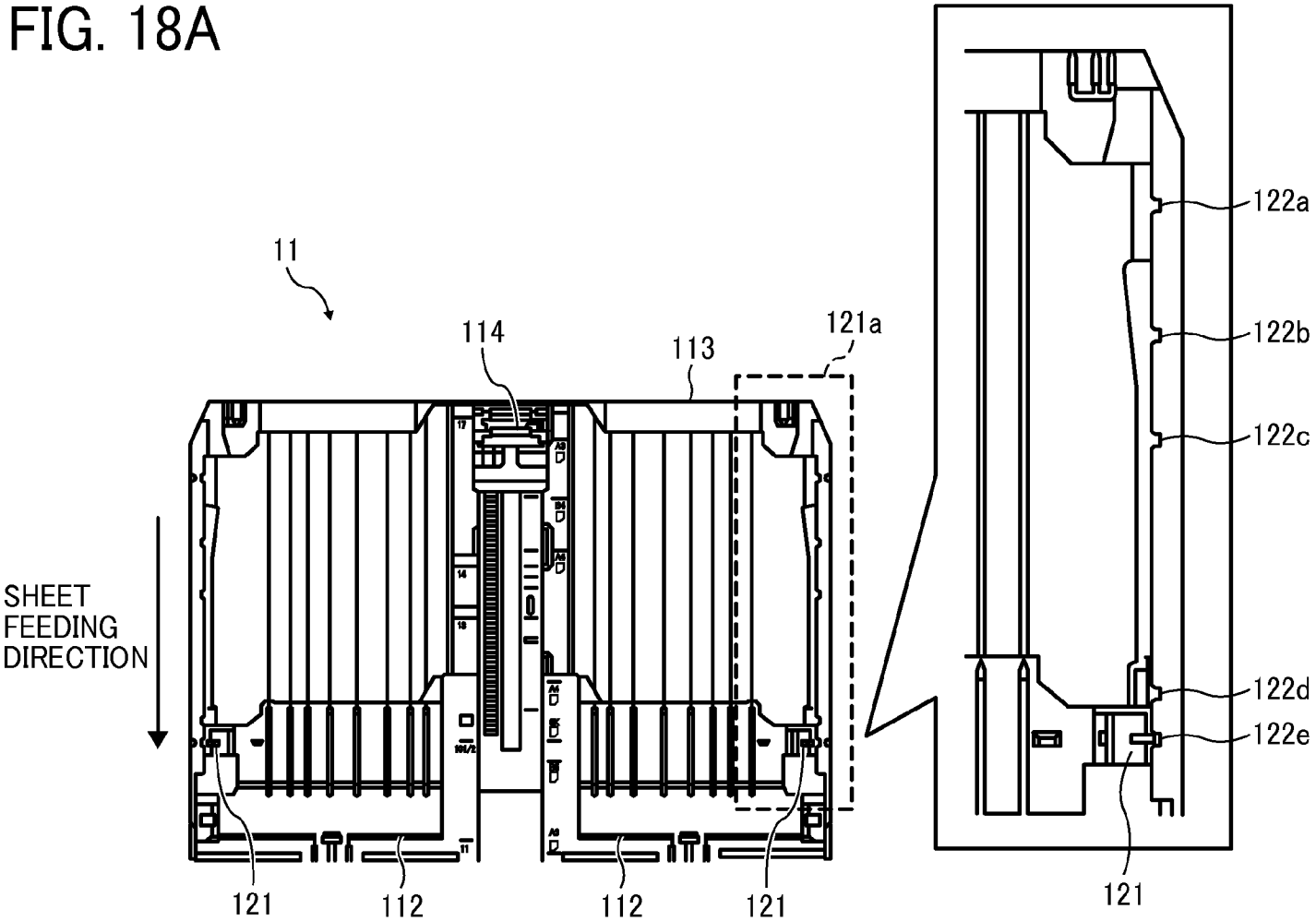
FIG. 18A is a plan view illustrating the rear half of the sheet container according to yet another example of this disclosure, with an enlarged part of an extension unit regulator and parts therearound.

FIG. 18A illustrates the rear half of the sheet container 11. In this example, the sheet container 11 includes an extension unit regulator 121 having a projection at both left and right side faces of the container body 112. Each extension unit regulator 121 is selectively engaged with one of multiple restriction grooves 122*a* through 122*e* disposed in an inner side of the left and right side faces of the extension unit 113. In this example, the sheet container 11 includes five (5) restriction grooves 122*a* through 122*e*.

Figure 18B:
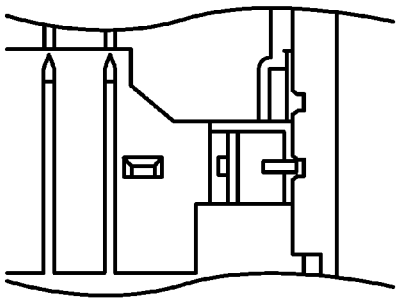
FIG. 18B is a top view illustrating the extension unit regulator in a state in which the extension unit regulator is engaged with one of restriction grooves.
Figure 18C:
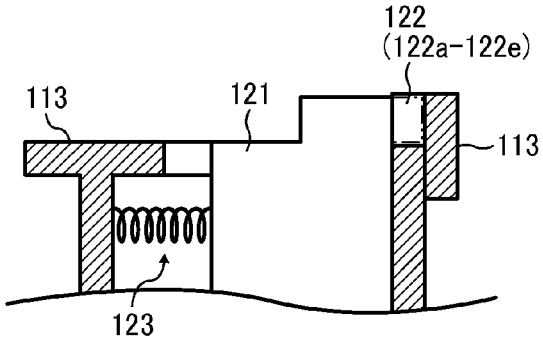
FIG. 18C is a cross sectional view illustrating the extension unit regulator biased by a biasing member in the state of FIG. 18B.
Figure 18D:
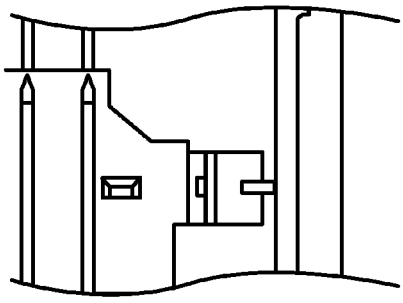
FIG. 18D is a top view illustrating the extension unit regulator in a state in which the extension unit regulator is not engaged with any one of the restriction grooves.
Figure 18E:
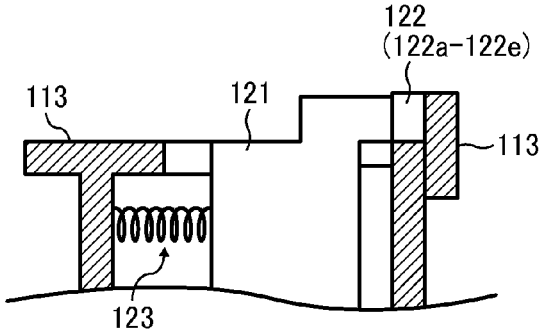
FIG. 18E is a cross sectional view illustrating the extension unit regulator biased by the biasing member in the state of FIG. 18D.

FIG. 18B is a top view illustrating the extension unit regulator 121 in a state in which the extension unit regulator 121 is engaged with one of the restriction grooves 122*a* through 122*e*. FIG. 18C is a cross sectional view illustrating the extension unit regulator 121 biased by a biasing member 123 in the state of FIG. 18B. FIG. 18D is a top view illustrating the extension unit regulator 121 in a state in which the extension unit regulator 121 is not engaged with any one of the restriction grooves 122*a* through 122*e*. FIG. 18E is a cross sectional view illustrating the extension unit regulator 121 biased by the biasing member 123 in the state of FIG. 18D.

As illustrated in FIGS. 18B and 18C, the extension unit regulator 121 is biased by a biasing member 123 toward the restriction grooves 122*a* through 122*e*. With this configuration, the restriction groove 122*a* is engaged with the extension unit regulator 121 when the extension unit 113 is retracted at the minimum length. Further, the restriction groove 122*b* is engaged with the extension unit regulator 121 when the extension unit 113 is extended to the length of the 13-inch sheet P.

Further, the restriction groove 122*c* is engaged with the extension unit regulator 121 when the extension unit 113 is extended to the length of the 14-inch sheet P. The restriction groove 122*d* is engaged with the extension unit regulator 121 when the extension unit 113 is extended to the length of the A4 sheet P. The restriction groove 122*e* is engaged with the extension unit regulator 121 when the extension unit 113 is extended to the maximum length.

With this configuration, when the user extends the extension unit 113 from the container body 112, as the extension unit 113 is moved to any positions where respective possible lengths of sheet standard sizes can be set, the extension unit regulator 121 engages with the click feeling with one of the restriction grooves 122*a* through 122*e* by the biasing member 123. This click feeling can facilitate the user that the extension unit 113 is stopped at an appropriate position when the user extends and retracts the extension unit 113.

Figure 19:
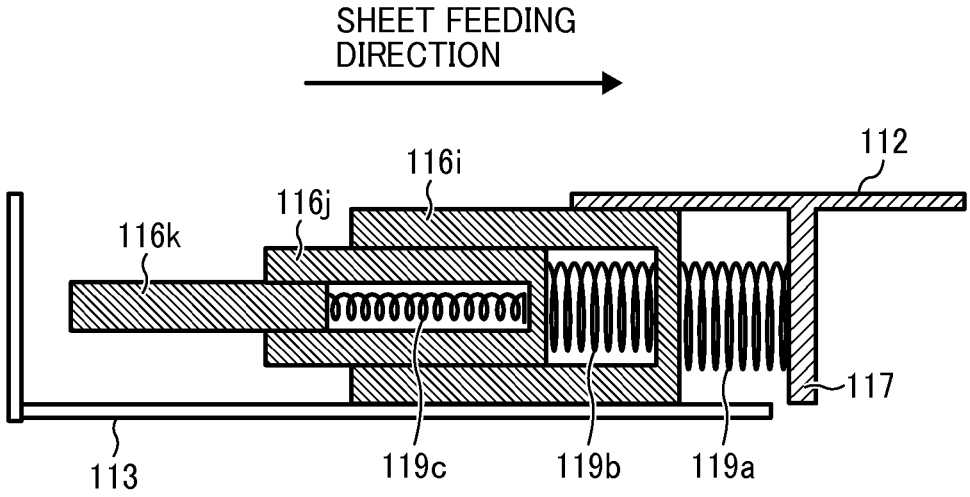
FIG. 19 is a cross sectional view illustrating the sheet container according yet another example of this disclosure, in a state in which the extension unit having the sheet size indicator is at the maximum extension position.

Next, a description is given of a different configuration of the sheet container 11 with reference to FIG. 19.

FIG. 19 is a cross sectional view illustrating the sheet container 11 according yet another example of this disclosure, in a state in which the extension unit having the indicator is at the maximum extension position.

As illustrated in FIG. 19, the sheet container 11 according to this example includes sheet size indicators 116*i*, 116*j*, and 116*k*. The sheet size indicators 116*i*, 116*j*, and 116*k* are concentrically combined in a three-stage cylindrical shape sheet size indicator that is extendable and retractable with respect to the container body 112. The container body 112 and the sheet size indicators 116*i* and 116*j* includes respective engagement projections and the sheet size indicators 116*i*, 116*j*, and 116*k* include respective engagement grooves.

Since the three cylindrical sheet size indicators 116*i*, 116*j*, and 116*k* are engaged with each other, the sheet size indicators 116*i*, 116*j*, and 116*k* themselves can restrict the positions vertically and laterally with respect to a surface of the sheet P without providing any restriction parts around the sheet size indicators 116*i*, 116*j*, and 116*k*.

Further, since a combination of multiple sheet size indicators (e.g., the sheet size indicators 116*i*, 116*j*, and 116*k*) can be handled as an integrated unit, higher maintainability can be obtained. Further, since each sheet size indicator can be selected from multiple sheet size indicators indicating different sheet sizes, possible options of sheet sizes corresponding to user's needs can easily be increased.

Figure 20A:
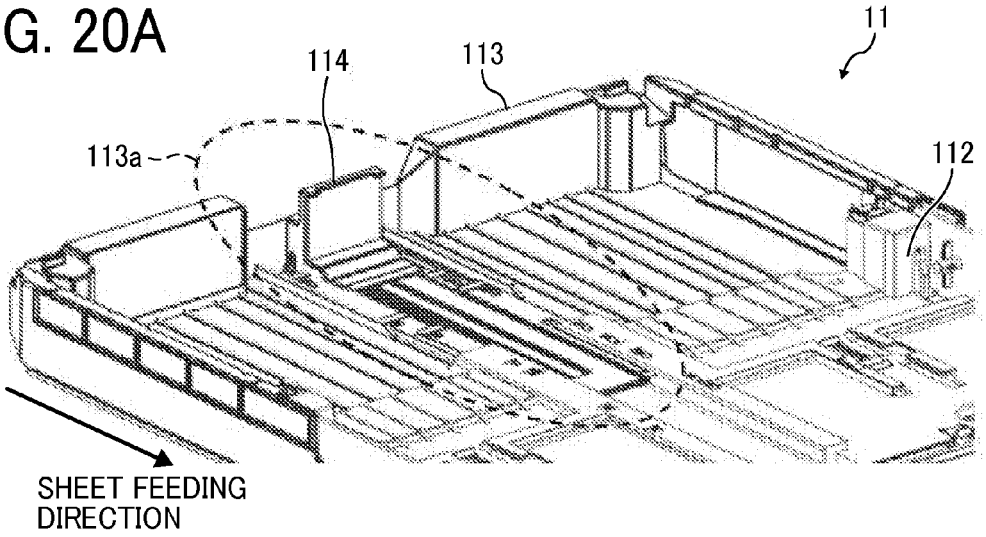
FIG. 20A is a perspective view illustrating the rear half of the sheet container according to yet another example of this disclosure.
Figure 20B:
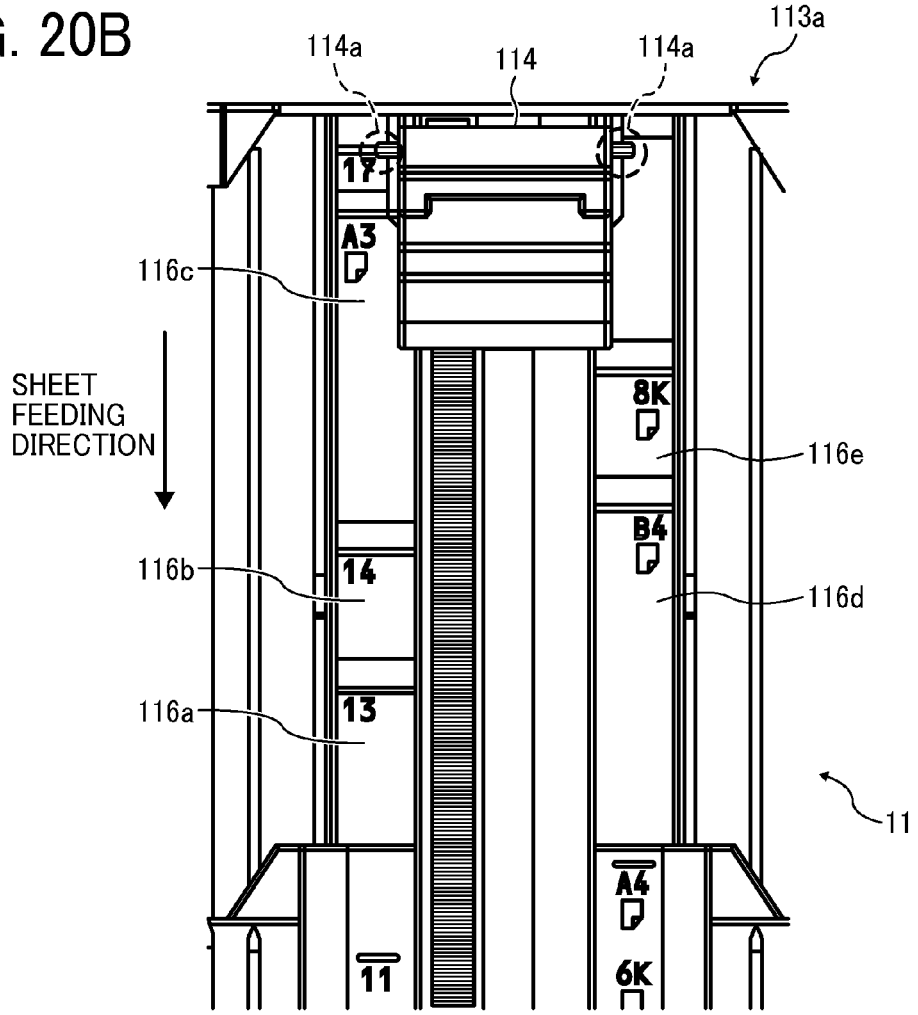
FIG. 20B is a plan view illustrating a main part of the rear half of the sheet container according to this example.

Next, a description is given of a different configuration of the sheet container 11 according to yet another example with reference to FIGS. 20A and 20B.

FIG. 20A illustrates the rear half of the sheet container 11 and FIG. 20B illustrates a main part of the rear half of the sheet container 11.

The configuration of the sheet container 11 according to this example includes respective sheet size mark pointers 114*a* at both left and right ends of the sheet trailing end regulator 114 in the sheet feed direction. Each of the sheet size mark pointers 114*a* functions as an indication pointer and has an arrow shape to indicate a given sheet size mark on the corresponding size indicators 116*a*, 116*b*, 116*c*, 116*d*, and 116*e*.

With this configuration, the user can easily confirm from any angle whether or not the sheet size mark pointer 114*a* matches the sheet size mark of the corresponding one of the sheet size indicators 116*a*, 116*b*, 116*c*, 116*d*, and 116*e*. That is, visibility of the respective sheet size marks on the sheet size indicators 116*a*, 116*b*, 116*c*, 116*d*, and 116*e* is enhanced and setting of the sheet trailing end regulator 114 to an appropriate position is more facilitated, and therefore more appropriate and faster sheet feeding can be conducted.

Further, as illustrated in FIG. 20B, the sheet size indicators 116*a*, 116*b*, 116*c*, 116*d*, and 116*e* disposed on both left and right sides of the sheet trailing end regulator 114 of the sheet container 11 according to this example have different sheet size marks arranged on the left side and the right side of the sheet trailing end regulator 114. Consequently, more sheet sizes can be set.

Figure 21:
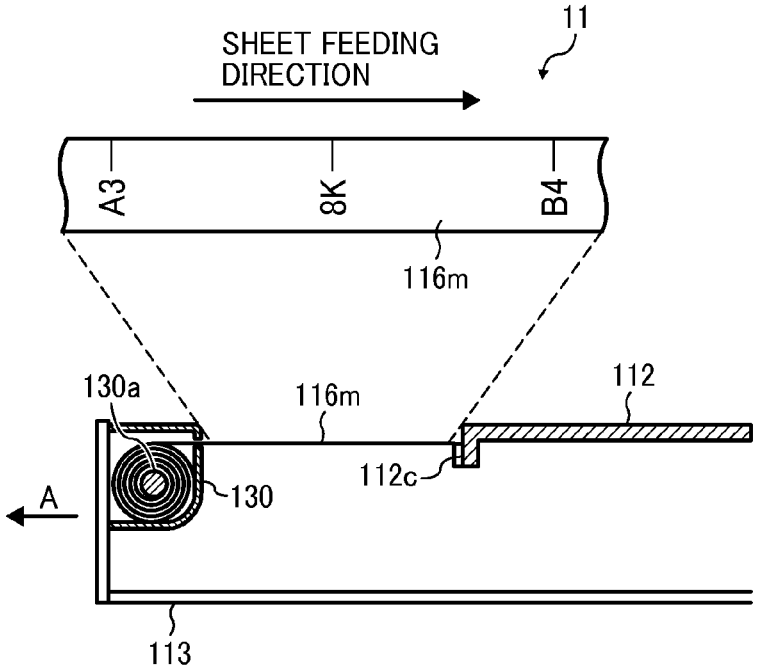
FIG. 21 is a cross sectional view illustrating the sheet container according yet another example of this disclosure, in a state in which the extension unit having the sheet size indicator is at the maximum extension position.

Next, a description is given of a different configuration of the sheet container 11 with reference to FIG. 21.

FIG. 21 is a cross sectional view illustrating the sheet container 11 according yet another example of this disclosure, in a state in which the extension unit 113 having a sheet size indicator 116*m* is at the maximum extension position. The configuration of the sheet container 11 according to this example has the sheet size indicator 116*m* of in a tape-like shape.

The sheet size indicator 116*m* can be taken up into a case 130 that has a take up shaft 130*a*. The case 130 is fixed to the inner face of the rear end of the extension unit 113. The leading end of the sheet size indicator 116*m* is fixed to the rear end 112*c* of the container body 112 and is fed from the case 130. As the extension unit 113 is extended in the pull out direction, which is a direction indicated by arrow A in FIG. 21, the sheet size indicator 116*m* comes out from the case 130. Further, as the extension unit 113 is moved in an opposite direction thereto, which is the sheet feeding direction, the sheet size indicator 116*m* is taken up to the case 130.

Accordingly, regardless of a pull-out position of the extension unit 113, the sheet size indicator 116*m* constantly maintains a horizontal state at a home position as illustrated in FIG. 21, and indicates the sheet size mark formed on the sheet size indicator 116*m* at a proper position to the container body 112. The sheet size indicator 116*m* can be aligned in one line or in multiple parallel lines to indicate more paper sizes.

Figure 22:
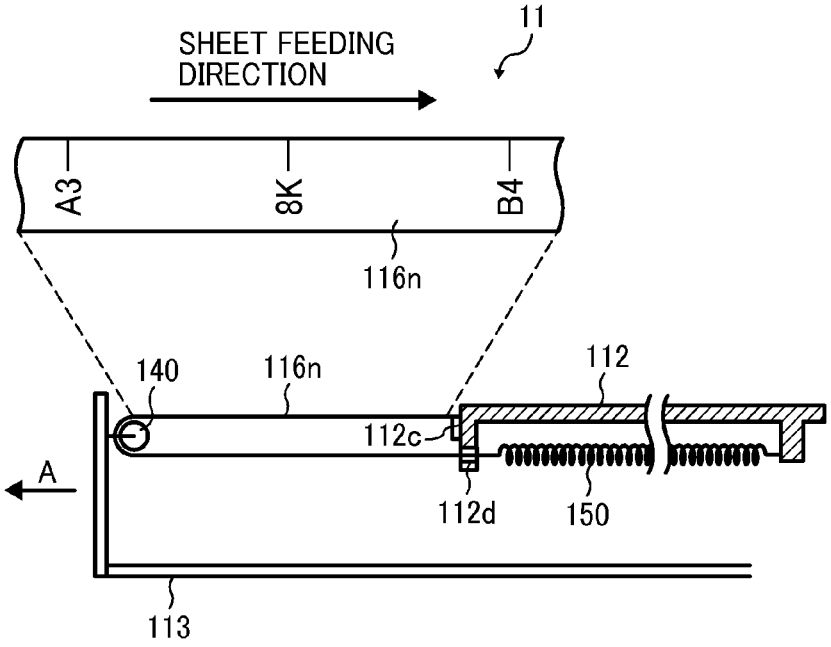
FIG. 22 is a cross sectional view illustrating the sheet container according yet another example of this disclosure, in a state in which the extension unit having the sheet size indicator is at the maximum extension position.

Next, a description is given of a different configuration of the sheet container 11 with reference to FIG. 22.

FIG. 22 is a cross sectional view illustrating the sheet container according yet another example of this disclosure, in a state in which the extension unit 113 having the sheet size indicator 116*n* is at the maximum extension position. Same as the example illustrated in FIG. 21, the configuration of the sheet container 11 according to this example has the sheet size indicator 116*n* in a tape-like shape.

One end of the sheet size indicator 116*m* is fixed to a rear end 112*c* of the container body 112. The other end or an opposite end to the one end of the sheet size indicator 116*n* is wound around a sheave 140 that is a rope pulley fixed to an inner face of the rear end of the extension unit 113 and passes through a guide opening 112*d* of the container body 112 so as to be connected to a tension spring 150.

Therefore, as the extension unit 113 is moved in the pull-out direction thereof, which is a direction indicated by arrow A in FIG. 22, a spring connection side of the sheet size indicator 116*n* is pulled out from the container body 112. Further, as the extension unit 113 is moved in an opposite direction thereto, which is the sheet feeding direction, the sheet size indicator 116*n* is inserted to the container body 112 by a force of the tension spring 150.

Accordingly, regardless of a pull-out position of the extension unit 113, the sheet size indicator 116*n* constantly maintains a horizontal state at a home position as illustrated in FIG. 22, and indicates the sheet size mark formed on the sheet size indicator 116*n* at a proper position to the container body 112. The sheet size indicator 116*n* can be aligned in one line or in multiple parallel lines to indicate more paper sizes.

The above-described examples have described the sheet container 11 of the image forming apparatus 1000 that is a laser printer. However, this disclosure is not limited thereto. For example, as previously described, the image forming apparatus 1000 may be a copier, a printer, a scanner, a facsimile machine, a plotter, a press, an ink jet machine, a multifunction peripheral or a multifunction printer (MFP) having at least two of copying, printing, scanning, facsimile, plotter, press, ink jet functions, and the like.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet container, comprising:

a container body having a loading face to load a sheet thereon;

an extension unit disposed extendable in a sheet feeding direction with respect to the container body to extend the loading face;

a length regulator disposed movable in the sheet feeding direction with respect to the extension unit to regulate a sheet trailing end position in the sheet feeding direction; and multiple sheet size indicators each having a strip-shape provided on the container body along with a moving direction of the extension unit as a reference of a position of the length regulator, having at least one sheet size mark to indicate a size of the sheet, wherein a distance from an upstream most end of a sheet size indicator to a downstream most end of another sheet size indicator is variable in length in a longitudinal direction with respect to the container body along with movement of the extension unit.

2. The sheet container according to claim 1, wherein the multiple sheet size are extendable and retractable along with the movement of the extension unit.

3. The sheet container according to claim 2, wherein the container body includes an engagement part provided at a given position thereof and the multiple sheet size indicators include an engagement target to be engaged with the engagement part, wherein the engagement target engages with the engagement part before the extension unit reaches a maximum extension position to stop the multiple sheet size indicators.

4. The sheet container according to claim 1, wherein the length regulator includes an indication pointer to indicate a sheet size mark of a respective sheet size indicator.

5. The sheet container according to claim 1, wherein the multiple sheet size indicators are stacked in a multilayered manner having respective sheet size marks, and wherein each of the multiple sheet size indicators are movable relative to one another in steps as the extension unit is extended.

6. The sheet container according to claim 5, wherein the multiple sheet size indicators are strip-shaped members in the multilayered manner in a sheet stacking direction.

7. The sheet container according to claim 5, wherein the multiple sheet size indicators are concentrically combined in a cylindrical shape.

8. The sheet container according to claim 5, wherein the multiple sheet size indicators include respective engagement grooves, each of which extends in a moving direction of the multiple sheet size indicators and has an engagement target at one end of each of the multiple sheet size indicators, wherein the container body has a common engagement part, wherein the common engagement part of the container body is inserted into all of the respective engagement grooves of the multiple sheet size indicators, wherein, according to lengths of the respective engagement grooves of the multiple sheet size indicators, stop positions of the multiple sheet size indicators are regulated.

9. The sheet container according to claim 5, wherein the multiple sheet size indicators include respective engagement grooves, each of which extends in a moving direction of the multiple sheet size indicators and has an engagement target at one end of each of the multiple sheet size indicators, wherein the container body has an engagement part and the multiple sheet size indicators have respective engagement parts, wherein the engagement part of the container body is inserted into the engagement groove of one adjacent sheet size indicator disposed adjacent to the container body and the engagement part of one of the multiple sheet size indicators is inserted into the engagement groove of an adjacent sheet size indicator disposed adjacent to the one of the multiple sheet size indicators, wherein, by insertion of the engagement part of the container body into the engagement groove of the one adjacent sheet size indicator and insertion of the engagement part of the one sheet size indicator of the multiple sheet size indicators into the engagement groove of the adjacent sheet size indicator, stop positions of the multiple sheet size indicators are regulated.

10. The sheet container according to claim 9, wherein the multiple sheet size indicators include respective downstream end parts in the sheet feeding direction of the engagement groove thereof, wherein each of the engagement part of the container body and the engagement part of the one of the multiple sheet size indicators includes an engagement projecting part and each of the downstream end parts includes an engagement recessed part, wherein, when each of the multiple sheet size indicators extends to a maximum extension position, the engagement projecting part is engaged with the engagement recessed part.

11. The sheet container according to claim 10, wherein the engagement projecting part is provided separately from the engagement part.

12. The sheet container according to claim 10, further comprising a projecting part biasing member to bias the engagement projecting part with respect to the engagement recessed part.

13. The sheet container according to claim 1, wherein the multiple sheet size each include an engagement groove and the container body includes a rear end biasing member, wherein the extension unit includes a contact face to contact a rear end of the multiple sheet size indicators with the rear end biasing member.

14. The sheet container according to claim 13, wherein the rear end biasing member is disposed in the engagement groove of the sheet size indicator.

15. The sheet container according to claim 1, wherein the extension unit comprises a width direction regulator to regulate both sides in a width direction of the multiple sheet size indicators perpendicular to a moving direction of the multiple sheet size indicators.

16. The sheet container according to claim 1, wherein the container body comprises a width direction regulator to regulate both sides in a width direction of the multiple sheet size indicators perpendicular to a moving direction of the multiple sheet size indicators.

17. The sheet container according to claim 3, wherein each of the multiple sheet size indicators includes an engagement groove to regulate the engagement part of the container body at both sides in a width direction thereof perpendicular to a moving direction of the multiple sheet size indicators.

18. The sheet container according to claim 1, wherein the multiple sheet size indicators include respective engagement grooves, wherein the container body has an engagement part and the multiple sheet size indicators have respective engagement parts, wherein, by insertion of the engagement part of the container body into an engagement groove of one adjacent sheet size indicator and insertion of the engagement part of one sheet size indicator of the multiple sheet size indicators into the engagement groove of the adjacent sheet size indicator, each of the sheet size indicators is regulated at both ends in a vertical direction perpendicular to a moving direction of the multiple sheet size indicators.

19. The sheet container according to claim 1, wherein the extension unit includes multiple restriction grooves along a moving direction of the extension unit according to the size of the sheet and the container body includes an extension regulator having a projection, wherein the extension regulator is selectively engaged with one of the multiple restriction grooves.

20. An image forming apparatus comprising:

the sheet container according to claim 1;

a sheet conveying device to convey the sheet fed from the sheet container;

an image forming device to form an image on the sheet conveyed by the sheet conveying device; and a sheet discharging device to discharge the sheet having the image formed by the image forming device.

* * * * *